US012669026B2

(12) United States Patent
Rasmussen et al.

(10) Patent No.: US 12,669,026 B2
(45) Date of Patent: Jun. 30, 2026

(54) MECHANICAL RELEASE TOOL FOR DOWNHOLE WIRELINE

(71) Applicants: Jon Randall Rasmussen, Williston, ND (US); Brandon J. Fair, Queen Creek, AZ (US)

(72) Inventors: Jon Randall Rasmussen, Williston, ND (US); Brandon J. Fair, Queen Creek, AZ (US)

( * ) Notice: Subject to any disclaimer, the term of this patent is extended or adjusted under 35 U.S.C. 154(b) by 236 days.

(21) Appl. No.: 17/846,932

(22) Filed: Jun. 22, 2022

(65) Prior Publication Data

US 2023/0115354 A1 Apr. 13, 2023

Related U.S. Application Data

(60) Provisional application No. 63/249,890, filed on Sep. 29, 2021, provisional application No. 63/249,771, filed on Sep. 29, 2021.

(51) Int. Cl.
*E21B 29/04* (2006.01)
*E21B 29/00* (2006.01)

(52) U.S. Cl.
CPC ..... *E21B 29/04* (2013.01); *E21B 29/005* (2013.01)

(58) Field of Classification Search
None
See application file for complete search history.

(56) References Cited

U.S. PATENT DOCUMENTS 4,736,797 A * 4/1988 Restarick, Jr. ..... E21B 17/003 166/301
4,738,312 A * 4/1988 Wittrisch ..... E21B 17/025 166/54.5
4,746,246 A 5/1988 Cowan et al.
4,886,115 A * 12/1989 Leggett ..... E21B 33/072 166/217
4,909,321 A 3/1990 Petree
(Continued)

OTHER PUBLICATIONS https://www.youtube.com/watch?v=3EDSoOp_yYg Video of an early prototype of the Wireline Release Tool as developed by Jon Rasmussen and Brandon Fair, published Sep. 29, 2020 (Mr. Rasmussen is shown on the video); 1 page.
Screen shots of text-mail communications between Jon Rasmussen and Aaron Holmberg showing that Mr. Rasmussen hired Mr. Holmberg and his partner (N. Kleinschmit) to assist in developing a prototype that was conceived of by Mr. Rasmussen and Mr. Fair; 13 pages.
(Continued)

*Primary Examiner* — Kipp C Wallace
(74) *Attorney, Agent, or Firm* — Peter L. Brewer; Thrive IP

(57) ABSTRACT

A wireline cutting tool. The wireline cutting tool comprises an elongated tubular body. A knife housing resides within the tubular body proximate an upper end, while a plunger resides within the tubular body proximate a lower end. An electric wireline passes through a bore of the knife housing and the plunger en route to an electrical connection sub. The electrical connection sub includes a pin that transmits signals from the electric wireline down to a downhole tool. The plunger is configured to slide up the bore of the lower sub in response to a first upward shear load applied by the wireline. This causes the plunger to act against knives residing within the knife housing. The knives are configured to travel up the bore of the upper sub in response to a second upward shear load applied by the plunger, pinching the wireline until severed. The second shear load is greater than the first shear load, creating a two-stage cutting tool.

24 Claims, 23 Drawing Sheets

(56) References Cited

U.S. PATENT DOCUMENTS

| | | | | |
|---|---|---|---|---|
| 4,997,041 | A | 3/1991 | Petree | |
| 6,032,733 | A | 3/2000 | Ludwig et al. | |
| 6,591,912 | B2 | 7/2003 | Ross et al. | |
| 6,880,637 | B2 | 4/2005 | Myers, Jr. et al. | |
| 7,114,563 | B2 | 10/2006 | Rose | |
| 7,264,060 | B2 | 9/2007 | Wills | |
| 7,857,066 | B2 | 12/2010 | DiFoggio et al. | |
| 8,264,814 | B2 | 9/2012 | Love et al. | |
| 8,336,612 | B2 | 12/2012 | Robertson et al. | |
| 8,376,040 | B2 | 2/2013 | Birkeland et al. | |
| 8,424,595 | B2 | 4/2013 | Sach | |
| 8,505,633 | B2 | 8/2013 | McKee | |
| 9,476,275 | B2 | 10/2016 | Wells et al. | |
| 9,476,276 | B2 * | 10/2016 | Wells | E21B 29/04 |
| 9,587,465 | B2 * | 3/2017 | Smith | E21B 47/09 |
| 9,822,596 | B2 | 11/2017 | Clemens et al. | |
| 10,947,812 | B2 | 3/2021 | George et al. | |
| 11,002,100 | B2 | 5/2021 | Johnsen et al. | |
| 11,021,923 | B2 * | 6/2021 | Mulhern | E21B 23/0414 |
| 11,078,739 | B2 | 8/2021 | Davies et al. | |
| 11,078,762 | B2 | 8/2021 | Mauldin et al. | |
| 11,255,147 | B2 | 2/2022 | Eitschberger et al. | |
| 11,268,376 | B1 | 3/2022 | Jackson et al. | |
| 11,359,898 | B2 | 6/2022 | Perry et al. | |
| 2012/0018142 | A1 | 1/2012 | Spence | |
| 2022/0145716 | A1 * | 5/2022 | Kleinschmit | E21B 17/026 |

OTHER PUBLICATIONS

Comment regarding U.S. Patent Publ. No. 2022/0145716—this is not prior art. The date of publication is after the present application's effective filing date. In addition, Jon R. Rasmussen is named as an inventor in the provisional patent application filed for U.S. Patent Publ. No. 2022/0145716. Mssrs. Kleinschmit and Holmberg were hired as engineering consultants to build a prototype for field testing. Mssrs. Brandon Fair and Jon Rasmussen have been improperly omitted as inventors from U.S. Patent Publ. No. 2022/0145716; 0 pages.

Deposition of Aaron Holmberg taken Aug. 15, 2022 in the matter of Mechanical Revolution, LLC and NuWay Completion Supply, LLC. Notice that Mr. Holmberg admits under oath that a release tool was mailed to him by Jon Rasmussen in October of 2020 and that Mr. Holmberg was hired to source components for the tool; 23 pages.

Deposition of Brandon Fair taken Aug. 15, 2022 in the matter of Mechanical Revolution, LLC and NuWay Completion Supply, LLC. Mr. Fair confirms that the release tool was originally developed by him and Mr. Jon Rasmussen, with an additional safety feature being offered later by Mr. Holmberg; 33 pages.

"Order Denying Plaintiff's Claims of Patent Infringement, Breach of Contract, and Unjust Enrichment, and Granting Defendant's Request for Declaratory Judgment" from North Dakota District Court; Civil Case No. 53-2021-CV-01197; Issued Jul. 21, 2023; 20 pages.

* cited by examiner

MECHANICAL RELEASE TOOL FOR DOWNHOLE WIRELINE

STATEMENT OF RELATED APPLICATIONS

This application claims the benefit of U.S. Ser. No. 63/249,771 entitled "Mechanical Release Tool for Downhole Wireline." That application was filed on Sep. 29, 2021, and is incorporated herein in its entirety by reference.

This application also claims the benefit of U.S. Ser. No. 63/249,980 entitled "Electrical Connection Assembly for Downhole Wireline." That application was filed on Sep. 29, 2021, and is also incorporated herein in its entirety by reference.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

This section is intended to introduce selected aspects of the art, which may be associated with various embodiments of the present disclosure. This discussion is believed to assist in providing a framework to facilitate a better understanding of particular aspects of the present disclosure. Accordingly, it should be understood that this section should be read in this light and not necessarily as admissions of prior art.

FIELD OF THE INVENTION

The present disclosure relates to the field of hydrocarbon recovery operations. More specifically, the present invention relates to a wireline cutting tool used for releasing a downhole tool by severing the wireline within a wellbore. A novel electrical connection sub that releases the wireline from a downhole signal line is also provided.

Discussion of Technology

In the drilling of an oil and gas well, a near-vertical wellbore is formed through the earth using a drill bit urged downwardly at a lower end of a drill string. After drilling to a predetermined depth, the drill string and bit are removed and the wellbore is lined with a string of casing. An annular region is thus formed between the string of casing and the formation penetrated by the wellbore.

A cementing operation is conducted in order to fill or "squeeze" the annular region with cement along part or all of the length of the wellbore. The combination of cement and casing strengthens the wellbore and facilitates the zonal isolation of aquitards and hydrocarbon-producing zones behind the casing.

In connection with the completion of the wellbore, several strings of casing having progressively smaller outer diameters will be cemented into the wellbore. These will include a string of surface casing, one or more strings of intermediate casing, and finally a production casing. The process of drilling and then cementing progressively smaller strings of casing is repeated until the well has reached total depth. In some instances, the final string of casing is a liner, that is, a string of casing that is not tied back to the surface.

Within the last two decades, advances in drilling technology have enabled oil and gas operators to "kick-off" and steer wellbore trajectories from a vertical orientation to a horizontal orientation. A horizontal "leg" of each of these wellbores now often exceeds a length of one mile, and sometimes two or even three miles. This significantly multiplies the wellbore exposure to a target hydrocarbon-bearing formation. The horizontal leg will typically include production casing.

During the completion of the well, it is common to run certain tools into the well at the end of a long wireline. In the case of wells that are complete horizontally, the tools will be pumped into the wellbore at the end of the wireline. Such tools may include perforating guns, casing collar locators, plugs and well logging equipment.

The wireline is typically an electric line. The electric line will include an inner conductive wire, which may be a collection of copper or other conductive wires. In one aspect, the inner copper wire represents two insulated wires and a ground wire. The insulated wires may be solid wires or strands that have been braided or otherwise wrapped together.

The electric line will also include an armor layer that resides around the conductive wire core. The armor layer may include a plurality of metal wires which may or may not be stranded or braided. Alternatively, a carbon fiber layer may be used as the armor layer. Those of ordinary skill in the art will understand that a variety of armors are known.

The electric line will also have an outer insulating layer. The outer insulating layer is typically fabricated from a polycarbonate material, designed to withstand the high pressures and high temperatures of the wellbore. The polycarbonate material is also resistant to corrosion from hydrocarbon fluids and wellbore chemicals residing downhole.

The electric wireline will have a defined tensile strength. The tensile strength must be higher than any anticipated tension that may be applied to the line from the surface during pumping and unspooling. In addition, the wireline is designed to have a point of weakness. The point of weakness resides just above the downhole tool, typically at a connection sub. The point of weakness allows the operator to pull the wireline out of the hole in the event the connected downhole tool becomes stuck. This typically occurs when the downhole tool is being pulled through a so-called "dog leg" of the wellbore. The dog leg is a location at which a direction of the wellbore changes sharply, commonly found at a point of inflection between the near-vertical wellbore and the horizontal "leg" of the wellbore.

Severing the wireline at the point of weakness allows the operator to spool the electric line back out of the hole and then run a fishing tool into the wellbore. The fishing tool may be run into the hole at an end of coiled tubing, or other line having a substantially higher tensile strength than the electric line. The fishing tool is designed to catch the wireline tool at the connection sub so that the tool may be removed from the wellbore. If the "fishing expedition" is not successful, the downhole tools are lost. More significantly, the well itself may be lost and will need to be re-drilled.

A problem arises in connection with fishing the downhole tool, that being the frayed electric line can interfere with the operator's attempts to grab on to the head, or fishing neck, of the connection sub. Those of ordinary skill in the art will understand that the frayed electric line will expose many wires, fragments and loose ends. For this reason, a need exists for a way of severing the wireline in a clean and efficient manner without relying upon a point of weakness.

In lieu of a point of weakness, some wireline release mechanisms employ a so-called ballistic release tool. The ballistic release tool resides along the wireline below the casing collar locator (or CCL) and below the weight bars (sometimes referred to as sinker bars). If a perforating gun assembly becomes stuck, the operator can activate the ballistic release tool and bring out the CCL, the weight bars, and the wireline out of the wellbore and back to the surface. However, if the tool string is stuck above the ballistic release tool, or even on the weight bars, it does the operator no good to set off the ballistic release tool as that portion of the tool string below the ballistic release tool will disconnect and the tool string will remain stuck in the wellbore.

It is also observed that the ballistic release tool utilizes an explosive charge that severs the wireline in a violent and sometimes unpredictable manner. Ancillary damage can be done to the tools, or even the wellbore, while at the same time the wireline itself may not always separate.

Therefore, a need again exists for a method of severing an electric line from a downhole tool in a clean, predictable manner just above the casing collar locator or other downhole tools.

SUMMARY OF THE INVENTION

A wireline cutting tool is first provided herein. The wireline cutting tool is designed to be run into a wellbore on a wireline with a downhole tool. Examples of a downhole tool include a casing collar locator (CCL) and a perforating gun assembly. The wireline cutting tool is used to sever the wireline in the event that the downhole tool becomes stuck during pull-out. Preferably, the wellbore wireline is an electric wireline.

The cutting tool comprises an upper tubular sub and a lower tubular sub. Each of the subs has a first end and a second end, the second end being opposite the first end, and with a bore extending from the second end and through the first end. The first end of the lower sub is threadedly connected to the second end of the upper sub. Preferably, the second end of the upper sub comprises female threads, while the first end of the lower sub comprises male threads.

The cutting tool also includes a knife housing. The knife housing resides within the bore of the upper sub. The knife housing has a first end, a second end opposite the first end, and a bore extending from the second end up to and through the first end. Of interest, the bore of the knife housing tapers inwardly moving in a direction from the second end of the upper sub toward the first end of the upper sub.

The cutting tool additionally comprises a tubular plunger. The plunger resides within the bore of the lower sub. The plunger has a first end, and a second end opposite the first end. The plunger is configured to slide up the bore of the lower sub in response to a first shear load applied by a wellbore wireline.

The cutting tool also includes at least one knife. Preferably, two knives are provided, with the knives residing on opposing sides of the bore of the knife housing. The knives are configured to slide up the bore of the knife housing from the second end towards the first end in response to a second shear load. The second shear load is greater than the first shear load.

In operation, the sliding up of the plunger causes the first end of the plunger to engage a lower end of each of the knives. In turn, the sliding up of the knives causes the wellbore wireline to be pinched and ultimately severed.

The wireline cutting tool is designed so that the first shear load is applied by the wireline being spooled from a surface. Thereafter, the second shear load is applied by the plunger acting against the knives from below. At the same time, the force applied by the plunger is also caused by the spooling of the wireline from the surface at the second shear load.

In a preferred embodiment, the wireline cutting tool further comprises an electrical connection sub. The electrical connection sub defines a tubular body, with the tubular body having a shoulder along an outer diameter that abuts the second end of the plunger from below. A first end of the electrical connection sub is received within and is pinned to the plunger. The first end is an upstream end.

The electrical connection sub includes a bore which holds a pin connector. The bore is configured to receive a lower end of the wireline and places the wireline in electrical communication with the pin connector. The pin connector includes an elongated conductive pin that transmits signals from the electrical wireline down to a signal line for the downhole tools.

The bore of the upper sub, the bore of the knife housing, the bore of the plunger, and the bore of the electrical connection sub are aligned. Together, they pass signals from the surface to the downhole tools and back up to the surface.

The wireline cutting tool may include at least one shear pin that holds the plunger in place along the electrical connection sub. Preferably, the at least one shear pin holding the plunger in place comprises at least two shear pins, with the at least two shear pins being fabricated to break at the first shear load. More preferably, the shear pins releasably connect the second end of the plunger to the upper end of the electrical connection sub.

In addition, the wireline cutting tool may include at least one shear pin holding the at least one knife in place along the bore of the knife housing. Preferably, the at least one knife comprises a pair of knives disposed on opposing sides of the bore of the knife housing. In this instance, the at least one shear pin holding the at least one knife in place comprises at least one shear pin holding each of the two knives in place, respectively. The shear pins holding the two knives in place are fabricated to break at the second shear load.

A method of cutting a wireline within a wellbore is also provided herein. In one embodiment, the method first includes providing a wireline cutting tool. The wireline cutting tool may be configured in accordance with the tool disclosed above. In this respect, the wireline cutting tool will comprise:

an upper tubular sub;

a knife housing residing within the upper tubular sub;

at least one knife residing within the knife housing;

a lower tubular sub; and a plunger residing within the lower tubular sub.

The method also includes providing a downhole tool. The downhole tool may be, for example, a casing collar locator (including a CCL connector sub) or a perforating gun assembly. Preferably, the downhole tool includes a CCL connector sub, a casing collar locator, and then a perforating gun, all of which form a tool string.

The method further comprises connecting the downhole tool to the wireline cutting tool. Preferably, connecting the downhole tool to the cutting tool is accomplished by connecting the downhole tool to a lower end of an electrical connection sub. Connecting the downhole tool to the lower end of the electrical connection may be accomplished via a threaded connection. At the same time, the plunger is releasably connected to an upper end of the electrical connection sub.

The method then includes running an electric wireline through a bore of each of the knife housing and the plunger. An armor of the wireline is connected to the plunger. Preferably, this involves stripping away an outer insulating coating of the wireline, at least through the bore of the plunger. At the same time, conductive wires within the wireline are placed in communication with the electrical connection subby means of a banana clip or other substantially similar connect means. The electrical communication sub includes a novel pin connector assembly that transmits signals from the wireline down to the downhole tool.

The method also comprises pumping the electric wireline, the electrical connection sub, and the downhole tool into the wellbore. Typically, the wellbore will be completed to have a lengthy horizontal section. Many wells today are completed with horizontal sections that exceed one mile. The method then includes conducting a wellbore operation using the downhole tool. The wellbore operation may be, for example, a perforating operation, a plug setting operation, a well-logging operation, a formation fracturing operation, or combinations thereof.

The method may also comprise:

pulling the wireline cutting tool, the electrical connection sub, and the downhole tool out of a wellbore together by spooling the electric wireline from a surface;

upon detecting that the downhole tool has become stuck in the wellbore, further spooling the wireline up to a first shear load, causing the plunger to separate from the electrical connection sub and travel up a bore of the lower tubular sub, such that the plunger shoulders out against a lower end of the at least one knife;

still further spooling the wireline at a second shear load, causing the at least one knife to travel up the bore of the knife housing and sever the electric line within the wellbore, leaving the downhole tool in place within the wellbore; and still further spooling the wireline in order to remove the wireline from the wellbore.

In connection with the method, the second shear load is greater than the first shear load. Preferably, the shear loads act on shear pins, with one set of shear pins releasably holding the plunger onto the electrical connection sub and another set of shear pins releasably holding the knives in place along the bore of the knife housing. Beneficially, an upper end of the lower sub may include a grease pocket. Viscous fluid residing inside the grease pocket slows the travel of the plunger up the lower sub en route to the knife housing after the first shear load has been applied.

In one embodiment, the method further comprises:

running a fishing tool (or "overshot") into the wellbore;

landing the fishing tool onto an upper end of the wireline cutting tool; and pulling the wireline cutting tool and connected downhole tool out of the wellbore.

It is noted that the electrical connection sub will come out of the wellbore as part of the wireline downhole tool.

BRIEF DESCRIPTION OF THE DRAWINGS

So that the manner in which the present inventions can be better understood, certain illustrations, charts, and/or flow charts are appended hereto. It is to be noted, however, that the drawings illustrate only selected embodiments of the inventions and are therefore not to be considered limiting of scope, for the inventions may admit to other equally effective embodiments and applications.

DETAILED DESCRIPTION OF CERTAIN EMBODIMENTS

Definitions

Figure 1A:
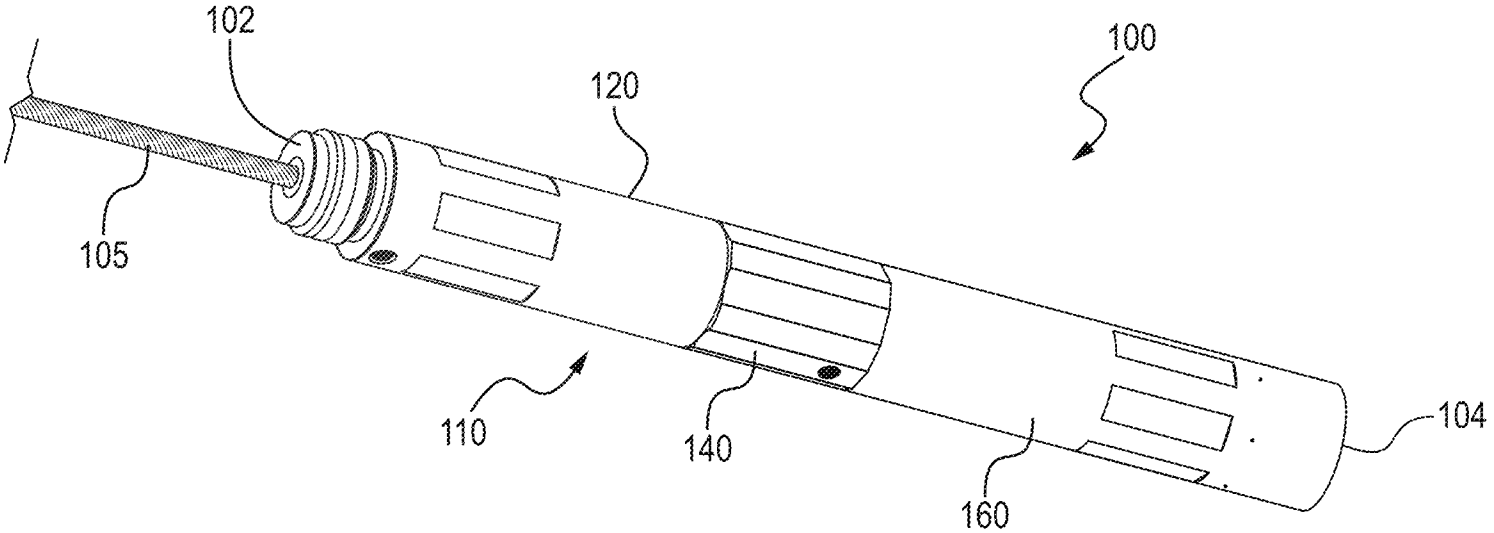
FIG. 1A is a perspective view of an illustrative wireline cutting tool of the present invention, in one embodiment. The cutting tool is designed to be placed at the end of an electric wireline and above a downhole tool.

For purposes of the present application, it will be understood that the term "hydrocarbon" refers to an organic compound that includes primarily, if not exclusively, the elements hydrogen and carbon. Examples of hydrocarbon-containing materials include any form of oil, natural gas, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions, or at ambient conditions. Hydrocarbon fluids may include, for example, oil, natural gas, condensate, coal bed methane, shale oil, shale gas, and other hydrocarbons that are in a gaseous or liquid state. The term hydrocarbon fluids may include other elements, such as, but not limited to, halogens, metallic elements, nitrogen, oxygen, and/or sulfur.

As used herein, the terms "produced fluids," "reservoir fluids," and "production fluids" refer to liquids and/or gases removed from a subsurface formation, including, for example, a hydrocarbon reservoir, a shale formation, or an organic-rich rock formation. Produced fluids may include both hydrocarbon fluids and non-hydrocarbon fluids. Production fluids may include, but are not limited to, oil, natural gas, pyrolyzed shale oil, synthesis gas, a pyrolysis product of coal, carbon dioxide, hydrogen sulfide, and water (including steam).

As used herein, the term "wellbore fluids" means water, hydrocarbon fluids, formation fluids, or any other fluids that may be within a string of production tubing during a production operation.

The term "subsurface interval" refers to a formation or a portion of a formation wherein formation fluids may reside. The fluids may be, for example, hydrocarbon liquids, hydrocarbon gases, aqueous fluids, or combinations thereof.

The terms "zone" or "zone of interest" refer to a portion of a formation containing hydrocarbons. Sometimes, the terms "target zone," "pay zone," or "interval" may be used.

As used herein, the term "formation" refers to any definable subsurface region regardless of size. The formation may contain one or more hydrocarbon-containing layers, one or more non-hydrocarbon containing layers, an overburden, and/or an underburden of any geologic formation. A formation can refer to a single set of related geologic strata of a specific rock type or to a set of geologic strata of different rock types that contribute to or are encountered in, for example, without limitation, (i) the creation, generation, and/or entrapment of hydrocarbons or minerals, and (ii) the execution of processes used to extract hydrocarbons or minerals from the subsurface.

As used herein, the term "wellbore" refers to a hole in the subsurface made by drilling or insertion of a conduit into the subsurface. A wellbore may have a substantially circular cross section or other cross-sectional shape. As used herein, the term "well," when referring to an opening in the formation, may be used interchangeably with the term "wellbore."

The terms "tubular" or "tubular member" refer to any pipe, such as a joint of casing, a portion of a liner, a joint of tubing, a pup joint, or coiled tubing. The terms "production tubing" or "tubing joints" refer to any string of pipe through which reservoir fluids are produced.

DESCRIPTION OF SPECIFIC EMBODIMENTS

FIG. 1A is a perspective view of an illustrative wireline cutting tool 100 of the present invention, in one embodiment. The wireline cutting tool 100 is designed to receive an electric wireline 105 that extends from a surface (not shown). The electric wireline 105 supports the wireline cutting tool 100 along with a connected downhole tool (shown at 800 in FIG. 8). The illustrative downhole tool 800 is a casing collar locator, or "CCL." However, it is understood that the tool 800 may be, for example, a perforating gun assembly, a cement bond log, a scraper, or other tool.

The wireline cutting tool 100 may also be referred to as a mechanical release tool. The wireline cutting tool 100 is designed to go into a wellbore along with a downhole tool 800 and serves as a release mechanism in the event the downhole tool becomes stuck. It is understood that the downhole tool may be part of a longer tool string that includes, for example, weight bars, a logging tool and a perforating gun assembly. These tools can become stuck at the dog-leg of a horizontally completed well, or even in a cork-screw portion.

The wireline cutting tool 100 has a first end 102, and a second end 104 that is opposite the first end 102. In oil and gas parlance, the first end 102 is an upstream end while the second end 104 is a downstream end. The electric wireline 105 passes through the upstream end 102 and is connected internally to a plunger (shown at 150 in FIGS. 5A-5C and in 950 in FIGS. 11A-11C). The plunger, in turn, is electrically connected to an electrical connection sub (shown at 190 in FIGS. 9C and 12A), described further below.

In the view of FIG. 1A, several components of the wireline cutting tool 100 are visible. These include an upper tubular sub 120, a lower tubular sub 140, and a connector sub 160. Together, the upper sub 120, the lower sub 140, and the connector sub 160 form a tubular body 110. It is understood that the connector sub 160 is used to connect the wireline cutting tool 100 to a lower downhole tool, e.g., the CCL.

Figure 1B:
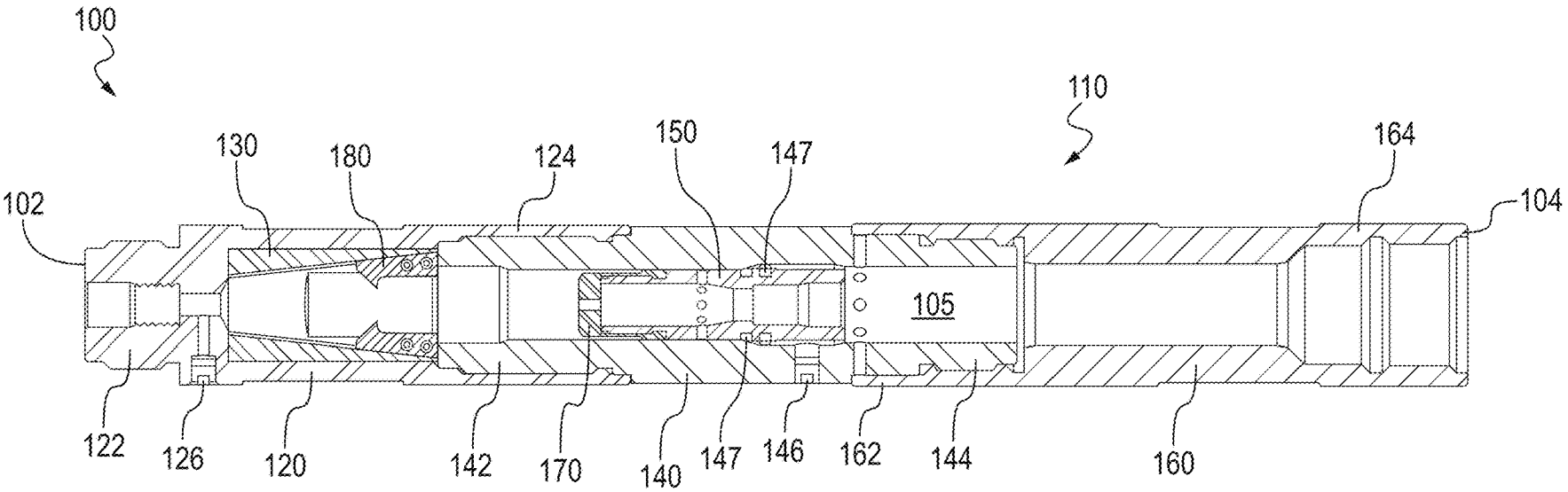
FIG. 1B is a cross-sectional view of the wireline cutting tool of FIG. 1A.

FIG. 1B is a cross-sectional view of the wireline cutting tool 100 of FIG. 1A. The upper sub 120, the lower sub 140, and the connector sub 160 are visible, forming the tubular body 110. Additional components can be seen internal to the body 110. These components include a knife housing 130, a pair of knives 180, and a dart 150. The dart 150 may also be referred to herein as the plunger. An elongated bore 105 extends through the components from the upstream end 102 to the downstream end 104.

Figure 2A:
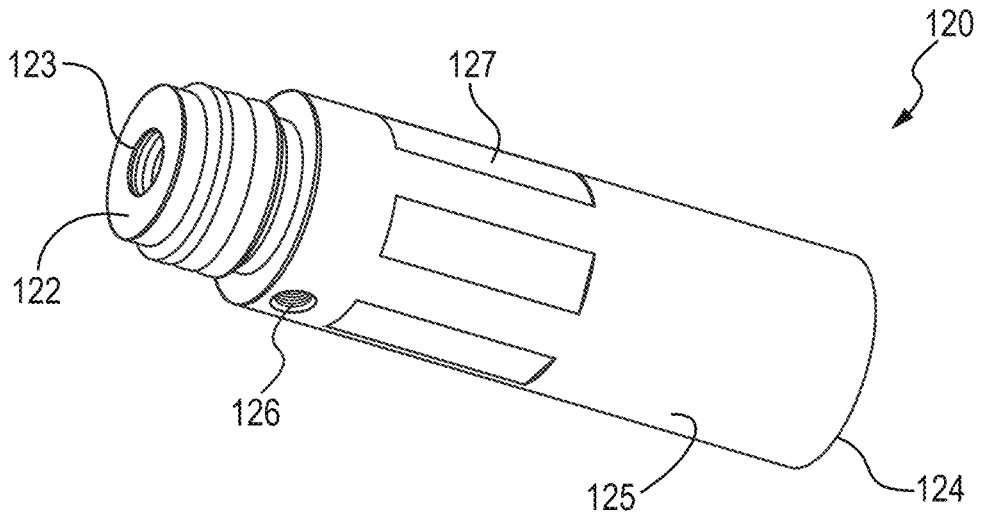
FIG. 2A is a perspective view of an upper tubular sub which forms part of the wireline cutting tool of FIGS. 1A and 1B.

FIG. 2A is a perspective view of the upper tubular sub 120. The upper sub 120 includes a first end 122 and a second end 124 which is opposite the first end 122. The first end 122 may include male threads while the second end 124 may include female threads. The first end 122 may be considered the upstream end while the second end 124 may be considered the downstream end.

The upper sub 120 defines a generally tubular body 125 extending between the first end 122 and second end 124. In one embodiment, the tubular body 125 includes a series of equi-radially disposed flats 127. The flats 127 are useful for turning the tubular body 125 or otherwise tightening the tubular body 125 onto the lower sub 140. Stated another way, and as shown in FIG. 1B, the second end 124 of the upper sub 120 threads onto a first end 142 of the lower sub 140.

Figure 2B:
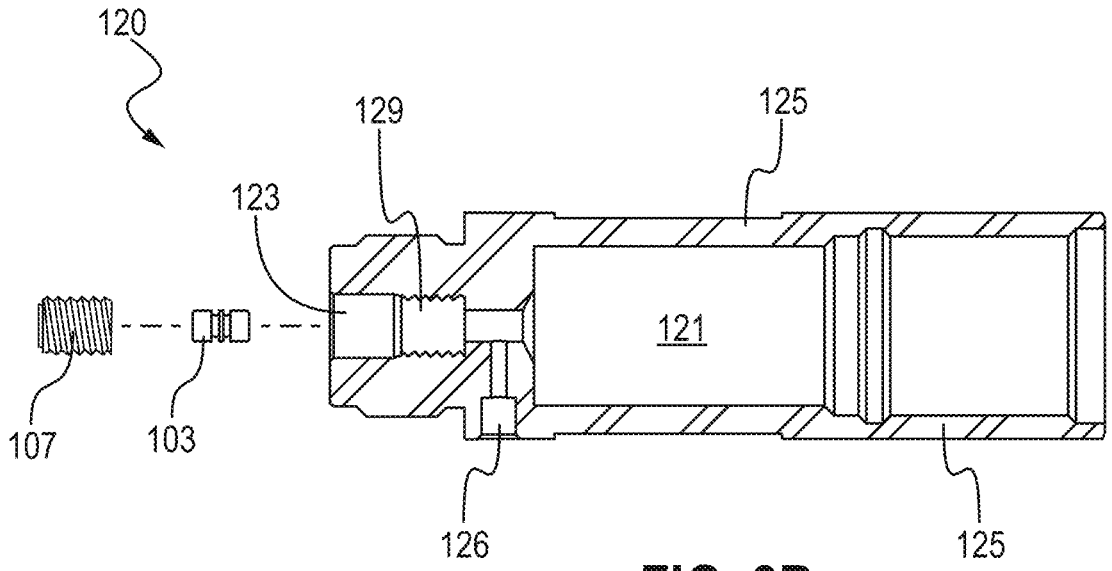
FIG. 2B is a cross-sectional view of the upper tubular sub of FIG. 2A. A hex nut is shown exploded away from a neck of the upper tubular sub.

FIG. 2B is a cross-sectional view of the upper tubular sub 120 of FIG. 2A. An inner bore 121 is seen within the tubular body 125 of the upper sub 120. Also, well-visible in the figure is a first grease port 126. The grease port 126 allows the operator to inject grease through the body 125 and into the bore 121 to lubricate the electric wireline 105. This is particularly helpful since the electric wireline (or cable) 105 traverses across knife blades 184 en route to the plunger 150 (or the plunger 950 shown in FIGS. 11A-11C described below).

Also visible in FIG. 2B is an upper bore portion 123. The upper bore portion 123 is dimensioned to receive a bushing 103. The bushing 103 contains an opening that slidably receives the electric wireline 105. The opening in the bushing 103 also allows grease to slide along the electric wireline 105. The bushing 103 may also have an outer elastomeric ring, for example an O-ring, (not shown) to assist in providing a seal along the upper bore portion 123.

A hex nut 107 is used to screw the bushing 103 down onto the first end 122 of the upper sub 120. Specifically, outer threads of the hex nut 107 screw into inner threads 129 along the upper bore portion 123, which serve to hold the bushing 103 in place.

Figure 3A:
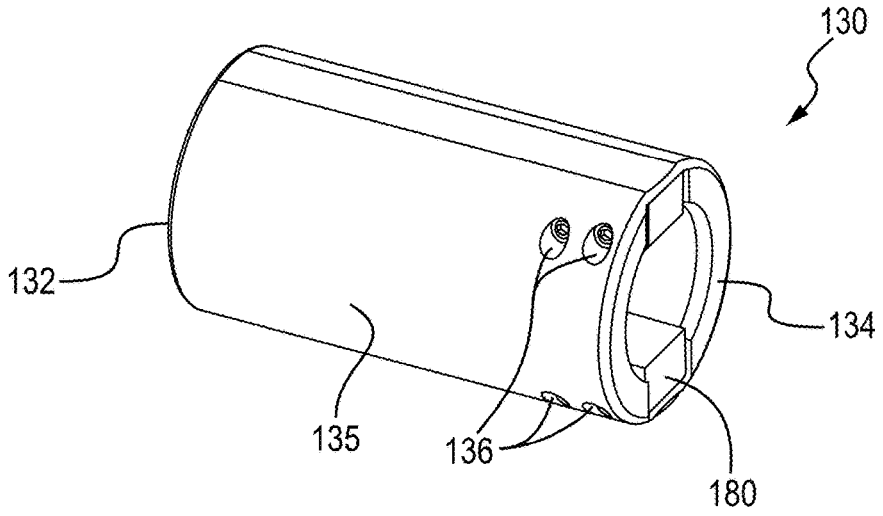
FIG. 3A is a perspective view of a knife housing which forms part of the wireline cutting tool of FIGS. 1A and 1B. The knife housing resides within the upper sub.

FIG. 3A is a perspective view of the knife housing 130, which forms a part of the wireline cutting tool 100 of FIG. 1A. The knife housing 130 includes a first end 132 and a second end 134 which is opposite the first end 132. The knife housing 130 defines a generally tubular body 135 extending from the first end 132 to the second end 134.

The tubular body 135 of the knife housing 130 include a series of through-openings 136. The series of through-openings 136 are dimensioned to receive pins (seen at 186 in FIG. 3B). The pins 186, in turn, secure opposing knives 180 in place within the knife housing 130. The pins 186 are designed to sheer at a designated load, referred to herein as a first selected shear load.

Figure 3B:
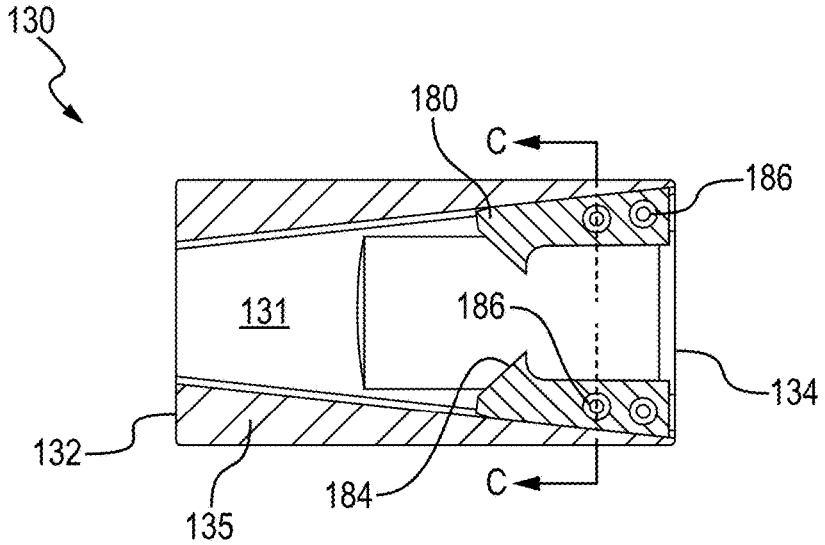
FIG. 3B is a cross-sectional view of the knife housing of FIG. 3A. A pair of knives is visible in the cross-sectional view of FIG. 3B.

FIG. 3B is a cross-sectional view of the knife housing 130 of FIG. 3A. An inner bore 131 is seen within the body 135 of the knife housing 130. The pins 186 are seen within the series of through-openings 136 of the tubular body 135.

It is observed from the cross-sectional view of FIG. 3B that the inner bore 131 is tapered. Specifically, the inner bore 131 becomes narrower as one moves upstream, that is, from the second end 134 towards the first end 132.

Figure 3C:
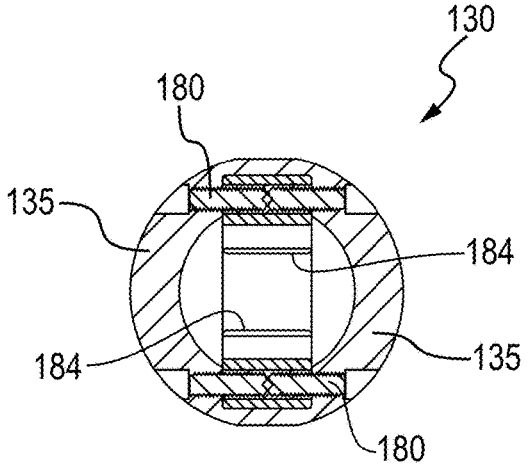
FIG. 3C is another cross-sectional view of the knife housing of FIG. 3A. The cut is taken across Line C-C of FIG. 3B.

FIG. 3C is another cross-sectional view of the knife housing 130 of FIG. 3A. The cut is taken across Line C-C of FIG. 3B. Knives 180 are seen at opposing sides of the body 135. The outer edges of the opposing knife blades 184 are illustrated.

Figure 4A:
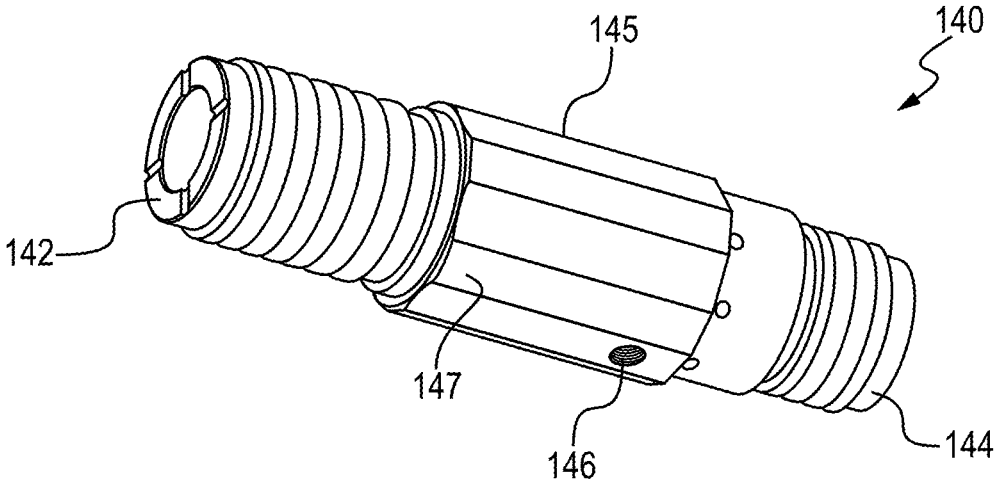
FIG. 4A is a perspective view of a lower sub which also forms part of the wireline cutting tool of FIGS. 1A and 1B. An upper end of the lower sub connects to a lower end of the upper sub.

FIG. 4A is a perspective view of the lower tubular sub 140, which again is a part of the wireline cutting tool 100 of FIGS. 1A and 1B. The lower tubular sub 140 includes a first end 142, and a second end 144 which is opposite the first end 142. The first end 142 may include male threads while the second end 144 may also include male threads.

The lower tubular sub 140 defines a generally tubular body 145 between the first 142 and second 144 ends. As shown in FIG. 1B, the first end 142 connects to the second end 124 of the upper sub 120, while the second end 144 connects to end 162 (discussed below). In one embodiment, the tubular body 145 includes a series of equi-radially disposed flats 147. The flats 147 are useful for turning the body 145 or otherwise tightening the tubular body 145 onto the upper sub 120 above and the connector sub 160 (or other downhole tool) below.

Figure 4B:
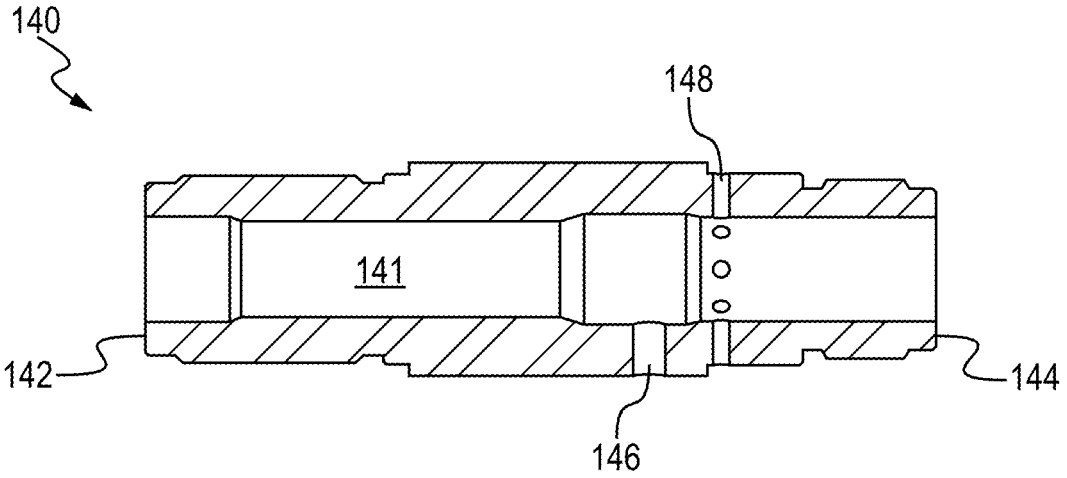
FIG. 4B is a cross-sectional view of the lower sub of FIG. 4A.

FIG. 4B is a cross-sectional view of the lower sub 140 of FIG. 4A. An inner bore 141 is seen within the body 145 of the lower sub 140. Also of interest, a second grease port 146 is provided. The grease port 146 enables the operator to inject grease into the inner bore 141 of the tubular body 145. A plurality of equi-radially disposed vent ports 148 are also provided through the body 145. These provide pressure balancing as the dart body (seen at 155 in FIG. 5A) moves up the inner bore 141 of the tubular body 145 during operation of the wireline cutting tool 100.

Figure 5A:
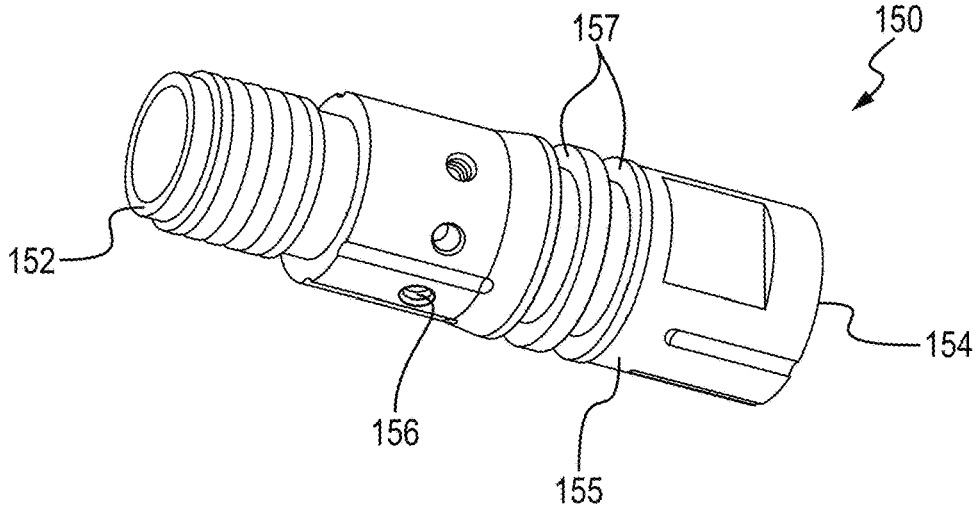
FIG. 5A is a perspective view of a dart which also forms part of the wireline cutting tool of FIGS. 1A and 1B. The dart resides within the lower sub.

The inner bore 141 of the lower sub 140 is dimensioned to hold a dart 150. FIG. 5A is a perspective view of the dart 150. The dart 150 includes a first end 152, and a second end 154 opposite the first end 152. The dart 150 defines a generally tubular dart body 155 extending from the first end 152 to the second end154. The dart body 155 may be referred to as a "socket body" as it generally resembles a socket.

Figure 5B:
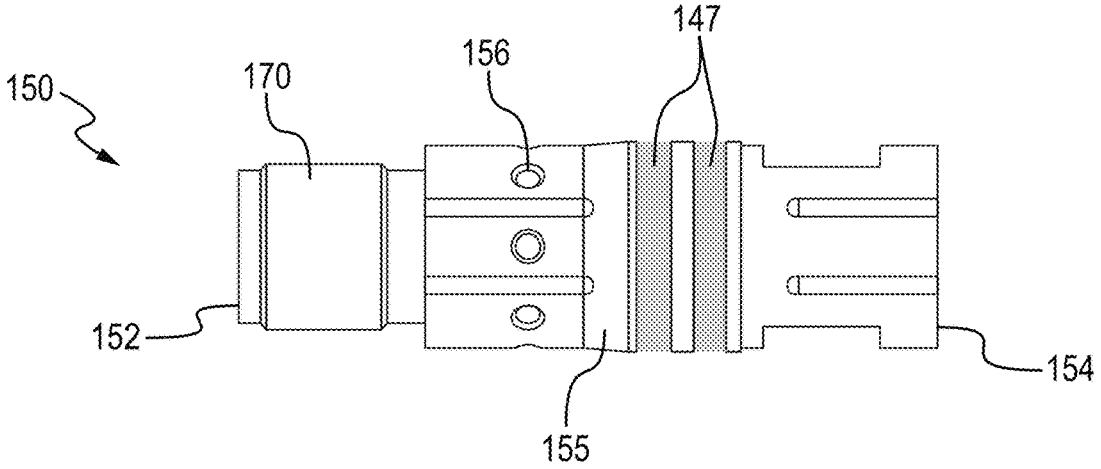
FIG. 5B is a side view of the dart of FIG. 5A. O-rings have been added to represent optional characteristics to the dart.
Figure 5C:
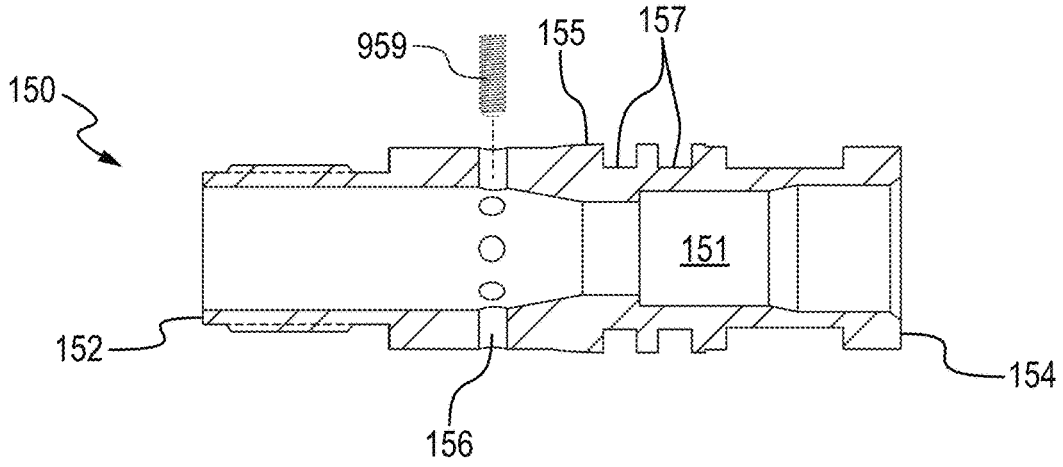
FIG. 5C is a cross-sectional view of the dart of FIG. 5A.

FIG. 5B is a side view of the dart 150 of FIG. 5A, while FIG. 5C is a cross-sectional view. It can be seen that the socket body 155 of the dart 150 includes a pair of radial recesses 157. The radial recesses 157 are dimensioned to receive O-rings, seen at 147 in FIG. 5B. The O-rings 147 provide a fluid seal between the dart 150 and the surrounding lower sub 140. At the same time, the O-rings 147 permit the socket body 155 to slide up the bore 141 of the lower sub 140.

Figure 7A:
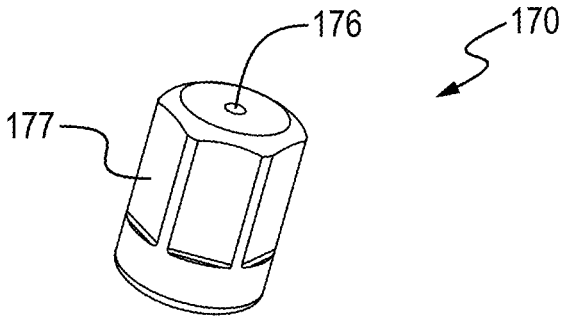
FIG. 7A is a perspective view of a dart cap. The dart cap also forms part of the wireline cutting tool of FIGS. 1A and 1B. The dart cap is visible in the cross-sectional view of FIG. 1B.
Figure 7B:
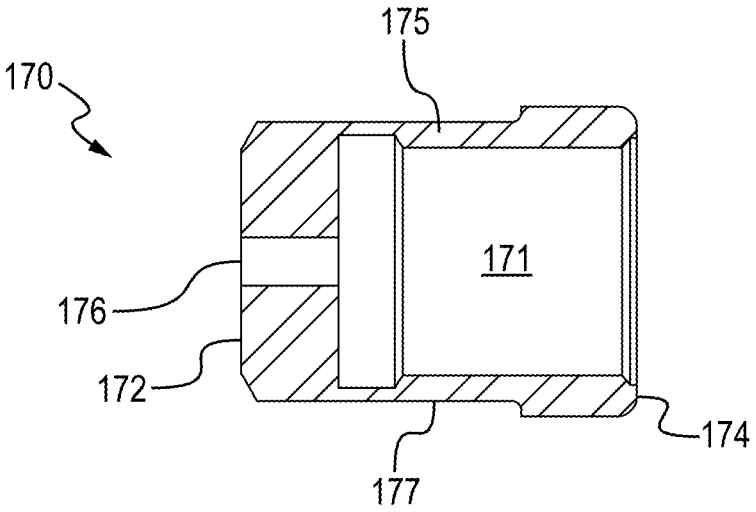
FIG. 7B is a cross-sectional view of the dart cap of FIG. 7A.

It can also be seen that a cap 170 has been placed over the upstream end 152 of the dart 150. The cap 170 is a dart cap and is screwed onto the threads at the upstream end 152. FIG. 7A is a perspective view of the dart cap 170, while FIG. 7B is a side, cross-sectional view of the dart cap 170 of FIG. 7A. The cap 170 is also visible in FIG. 1B. It is observed in each view that a through-opening 176 is provided in the cap 170 to accommodate the electric wireline 105.

Returning to FIG. 5B, it can also be seen that a series of through-openings 156 is provided in the body 155 of the dart 150. The series of through-openings 156 receive shear pins 959. The shear pins 959 releasably connect the dart 150 to an electrical connection sub, described below in connection with FIGS. 9A-9C. The shear pins 959 are designed to break at the first selected shear load.

FIG. 5C is a cross-sectional view of the dart 150 of FIGS. 5A and 5B. An inner bore 151 is seen within the socket body 155 of the dart 150. The inner bore 151 accommodates the electric wireline 105 as it passes through the through-opening 176 of the cap 170 and then through the dart 150. Here, the O-rings 147 have been removed.

As noted earlier, the lower end 154 of the dart 150 is dimensioned to receive an upper end of the electrical connection sub 190. The dart 150 is pinned to the electrical connection sub 190 using the shear pins 959.

Figure 6A:
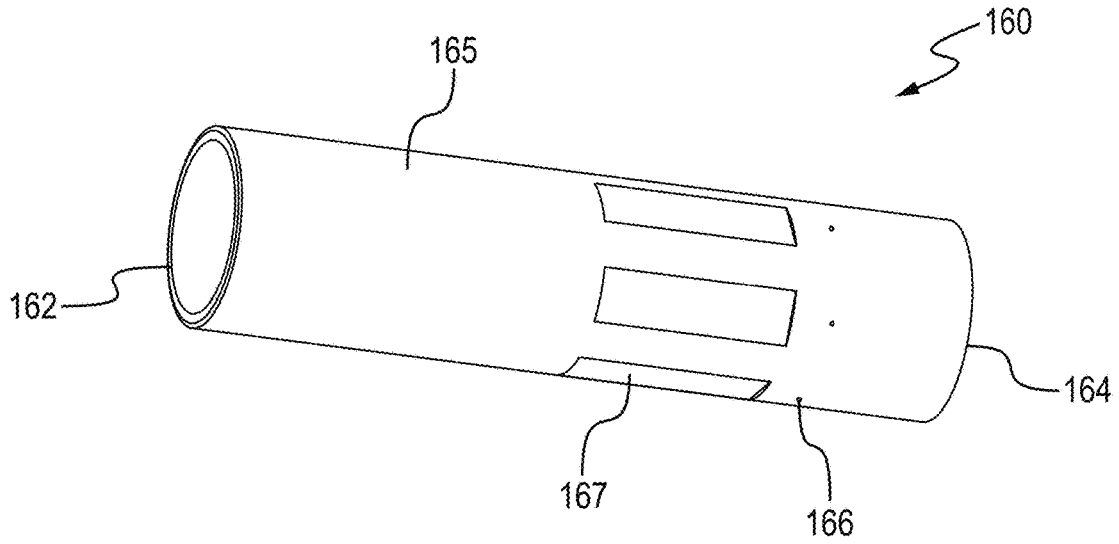
FIG. 6A is a perspective view of a connector sub. The connector sub connects the lower sub of FIG. 4A to a separate downhole tool.

FIG. 6A is a perspective view of the connector sub 160. The connector sub 160 connects the lower sub 140 of FIG. 4A to a separate downhole tool. The separate downhole tool may be, for example, a casing collar locator, or "CCL" (shown at 800 in FIG. 8). In this instance, the connector sub 160 is a CCL connector sub.

The connector sub 160 includes a first end 162, and a second end 164 opposite the first end 162. Each of the first end 162 and second end164 defines female threads. As noted above, first end 162 of the connector sub 160 connects to second end 144 of the lower tubular sub 140.

The connector sub 160 defines a generally tubular body 165 between the first 162 and second 164 ends. In one embodiment, the tubular body 165 includes a series of equi-radially disposed flats 167. The flats 167 are useful for turning the tubular body 165 or otherwise tightening the tubular body 165 onto the lower sub 140 above and the CCL 800 below.

Figure 6B:
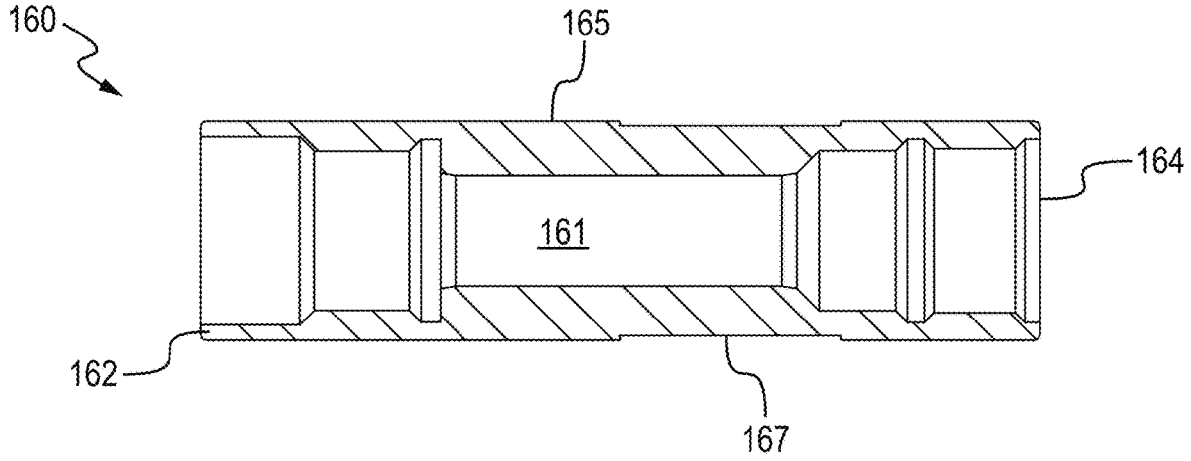
FIG. 6B is a cross-sectional view of the connector sub of FIG. 6A.

FIG. 6B is a cross-sectional view of the connector sub 160 of FIG. 6A. An inner bore 161 is seen within the tubular body 165 of the connector sub 160. Of interest, a plurality of equi-radially disposed vent ports 166 are provided through the tubular body 165. The vent ports 166 provide pressure balancing during operation of the downhole tool.

Referring again to FIGS. 7A and 7B, it can be seen that the dart cap 170 has a first end 172 and a second end 174. Internal to the cap 170 is a bore 171. As shown in FIG. 1B, the bore 171 receives the first end 142 of the dart 150. Flat surfaces 177 are disposed around the cap 170 to facilitate attachment of the cap 170 onto the upstream end 152 of the dart 150. A means for attachment may include screwing the cap 170 onto the upstream or first end 152 of the dart 150.

Figure 8:
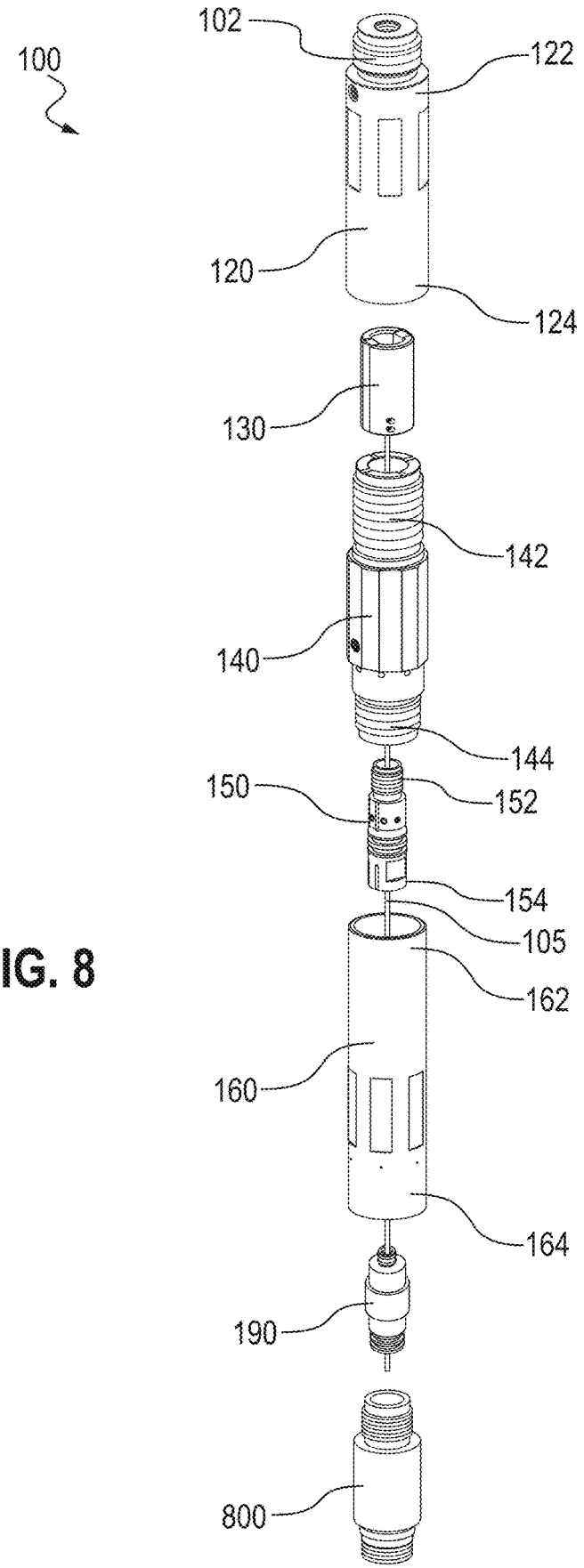
FIG. 8 is another perspective view of the wireline cutting tool of FIGS. 1A and 1B. Here, selected components of the tool are presented in exploded-apart relation. An electrical connection sub and an illustrative casing collar locator are provided at the bottom of the view.

FIG. 8 is another perspective view of the wireline cutting tool 100 of FIGS. 1A and 1B. Here, selected components of the wireline cutting tool 100 are presented in exploded-apart relation. Detailing components from the upstream end 102 to the downstream end 104, these include the upper tubular sub 120, the knife housing 130, the lower tubular sub 140, the dart 150, and the connector sub 160.

An electrical connection sub 190 and an illustrative casing collar locator 800 are provided at the bottom of the view. The electrical connection sub 190 is shown in more detail in FIGS. 12A-12C, described below.

The wireline cutting tool 100 described above is just one possible embodiment for providing a two-step mechanical release tool. The two steps represent the first shear load that separates the dart 150 from the electrical connection sub 190 followed by a second shear load that moves the knives 180 from a lower position within the knife housing 130 to an upper position. Moving the knives 180 up the upper sub 120 moves the blades 184 closer together, severing the electric wireline 105.

Figure 9A:
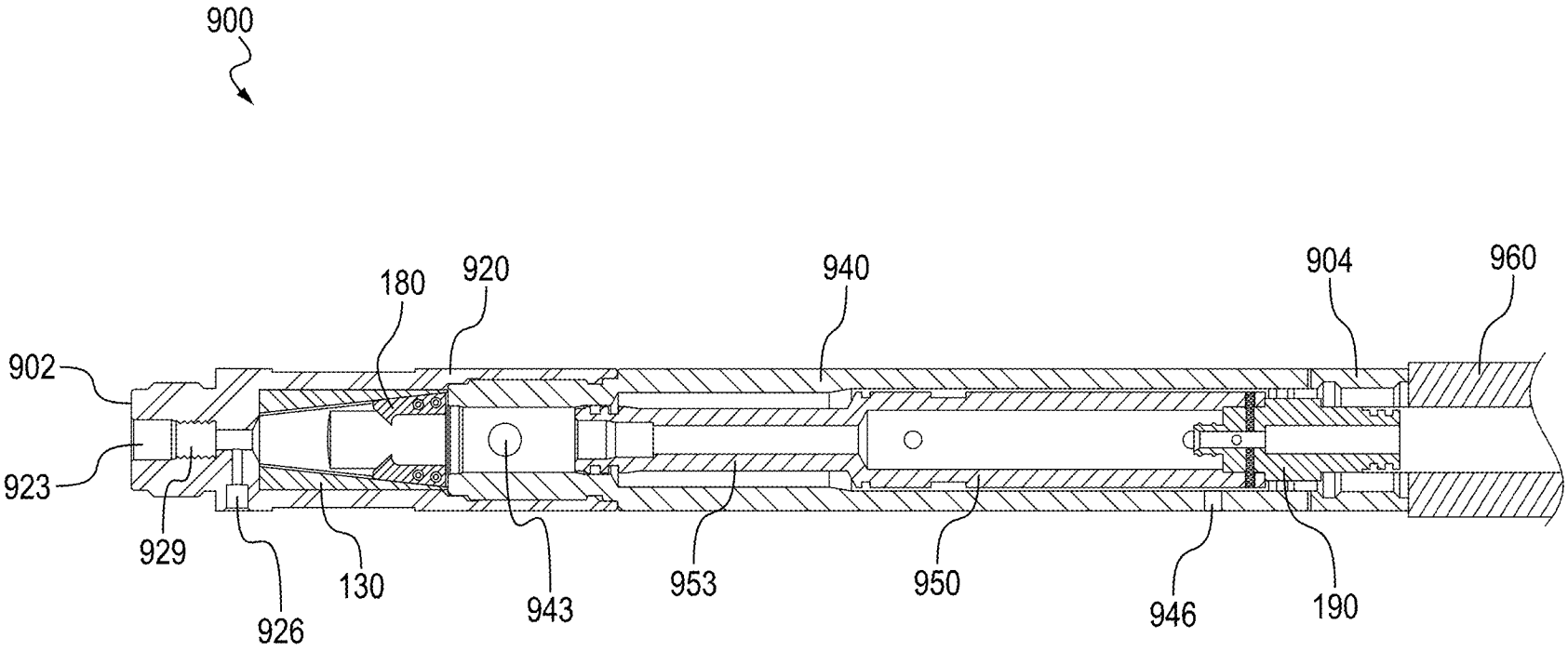
FIG. 9A is a cross-sectional view of a wireline cutting tool of the present invention, in an alternate embodiment. In this embodiment, the wireline cutting tool uses an elongated plunger rather than the short dart of FIG. 5B.

FIG. 9A is a cross-sectional view of a two-step wireline cutting tool 900 of the present invention, in an alternate embodiment. The wireline cutting tool 900 includes a first, or upstream end 902. The upstream end 902 includes a fishing neck. The cutting tool 900 also includes a second, or downstream end 904. The downstream end 904 connects to a connector sub 960, which may be in accordance with sub 160 of FIG. 6A.

As with the wireline cutting tool 100 of FIG. 1A, the wireline cutting tool 900 of FIG. 9A includes an upper tubular sub 920. The upper sub 920 is essentially in accordance with upper sub 120. Thus, details of the upper tubular sub 920 need not be repeated. An upper bore portion is indicated here at 923, with threads shown at 929. The upper bore portion 923 will receive the bushing 103 and hex nut 107 of FIG. 2B. A first grease port is also again seen (here shown at 926).

Figure 10A:
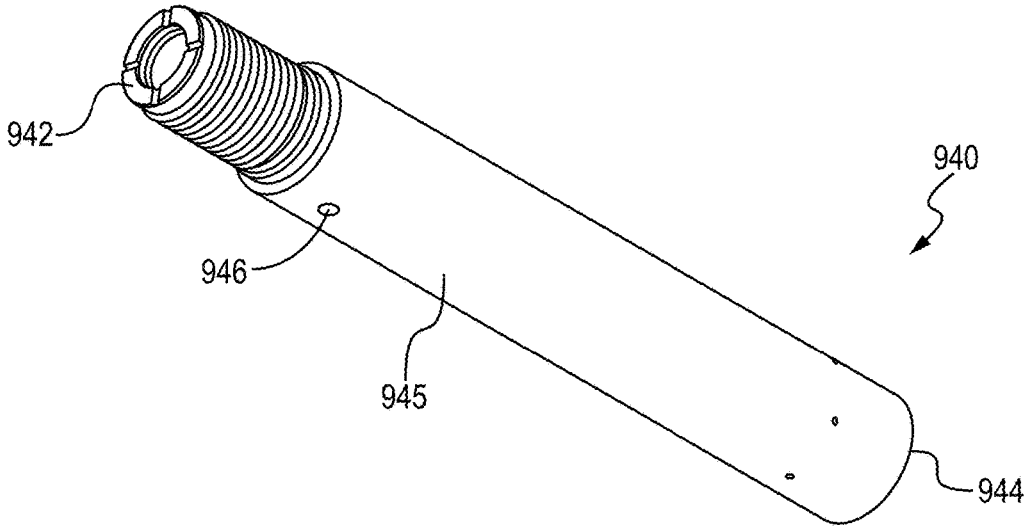
FIG. 10A is a perspective view of a lower tubular sub which forms part of the wireline cutting tool of FIGS. 9A, 9B, and 9C.

As with the wireline cutting tool 100 of FIG. 1A, the wireline cutting tool 900 of FIG. 9A also includes a lower tubular sub 940. FIG. 10A is a perspective view of the lower tubular sub 940. The lower sub 940 includes a first end 942 and a second end 944, which is opposite the first end 942. The first end 942 includes male threads while the second end 944 defines female threads. The lower sub 940 defines a generally tubular body 945 between the first 942 and second 944 ends. The first end 942 connects to an end 924 (shown in FIG. 15B), while the second end 944 connects to the connector sub 960.

Figure 10B:
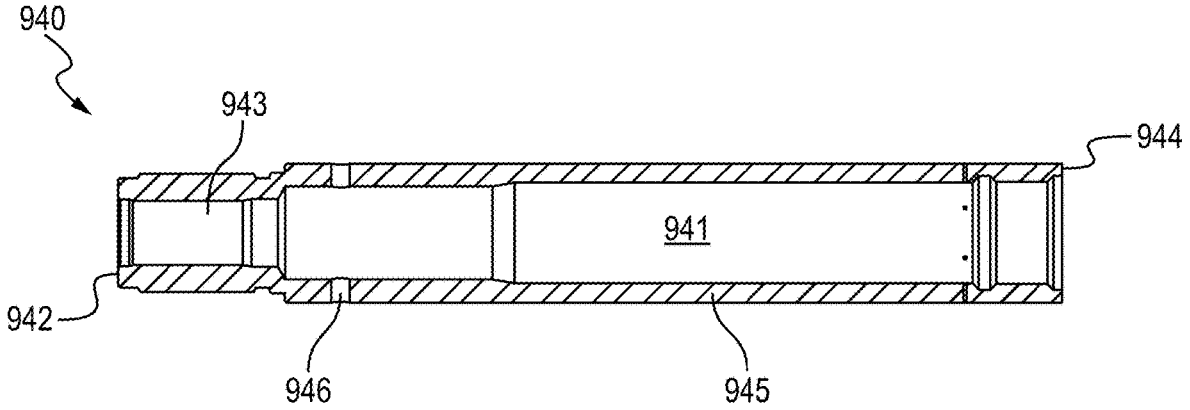
FIG. 10B is a cross-sectional view of the lower tubular sub of FIG. 10A.

FIG. 10B is a cross-sectional view of the lower sub 940 of FIG. 10A. An inner bore 941 is seen within the tubular body 945 of the lower sub 940. Also of interest, a second grease port 946 is provided. The second grease port 946 enables the operator to inject grease into the bore 941 of the tubular body 945 as discussed above in connection with lower sub 140. Grease travels into an upper area referred to as a grease trap 943. Sub 940 otherwise functions as sub 140, and additional details need not be repeated.

Figure 11A:
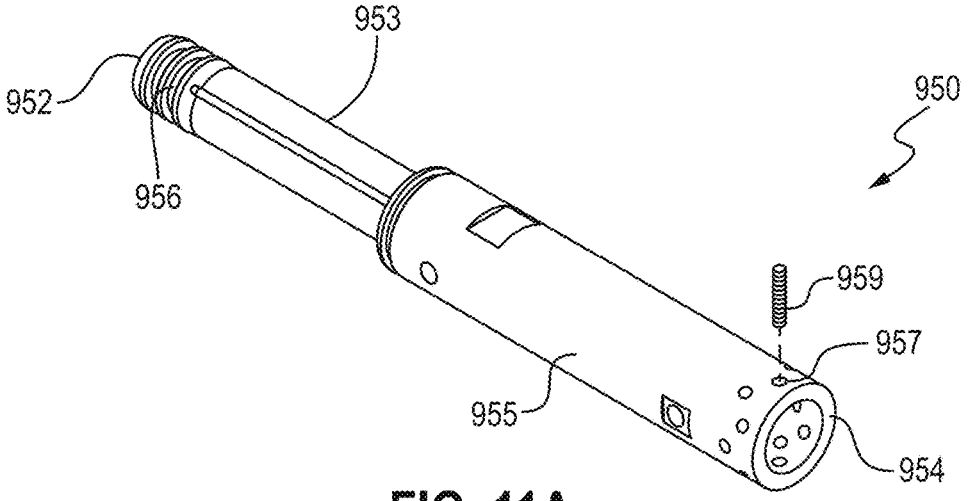
FIG. 11A is a perspective view of the plunger which forms part of the wireline cutting tool of FIGS. 9A, 9B, and 9C. The plunger resides within the lower sub but extends partially up into the upper sub.

Residing within the lower tubular sub 940 is a plunger 950. FIG. 11A is a perspective view of the plunger 950 from FIG. 9A. The plunger 950 includes a first end 952, and a second end 954 opposite the first end 952. The first end 952 defines an elongated portion having a reduced outer diameter, seen at 953. The elongated portion 953 is designed to advance into the upper tubular sub 920, where the first, or upstream, end 952 will engage the knives 180.

Figure 11B:
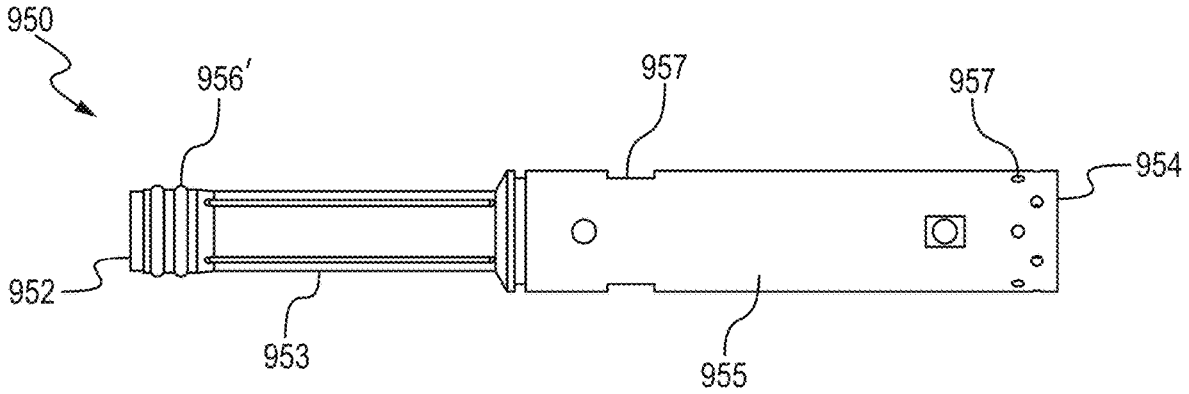
FIG. 11B is a side view of the plunger of FIG. 11A. Here, O-rings have been added at the upstream end.
Figure 11C:
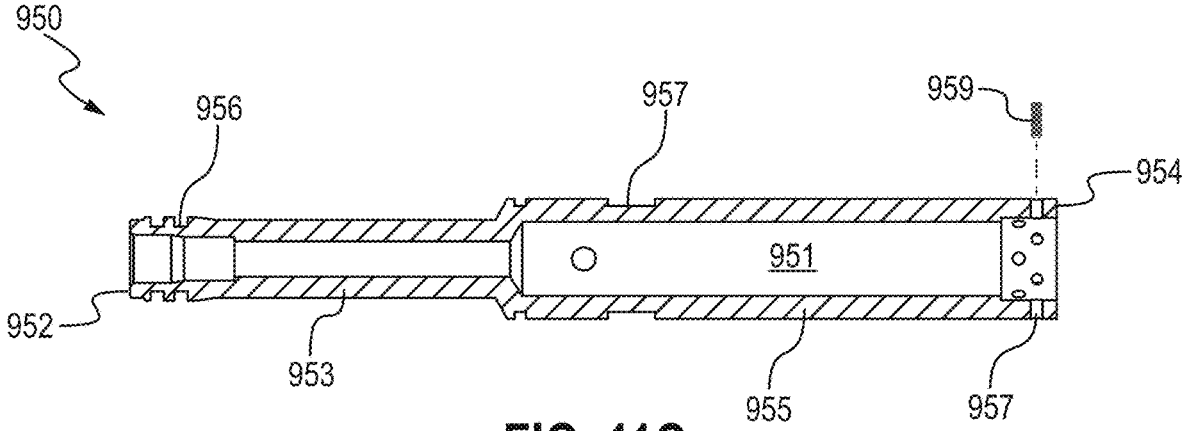
FIG. 11C is a cross-sectional view of the plunger of FIG. 11A. The O-rings have been removed.

FIG. 11B is a side view of the plunger 950 of FIG. 11A. FIG. 11C is a cross-sectional view of the plunger 950 of FIG. 11A.

It can be seen that the first end 952 includes recessed portions 956. The recessed portions 956 are designed to receive O-rings 956' (seen in FIG. 11B). With the O-rings 956' in place, a seal is provided along the annular region between the elongated portion 953 and the grease trap portion 943 of the surrounding bore 941 of the lower sub 940.

The plunger 950 defines a generally tubular body 955 extending from the first end 952 to the second end 954. Movement of the plunger 950 through the surrounding bore 941 of the lower sub 940 and up the wireline cutting tool 900 is inhibited, or at least slowed, by the presence of grease in the grease trap 943.

Figure 12A:
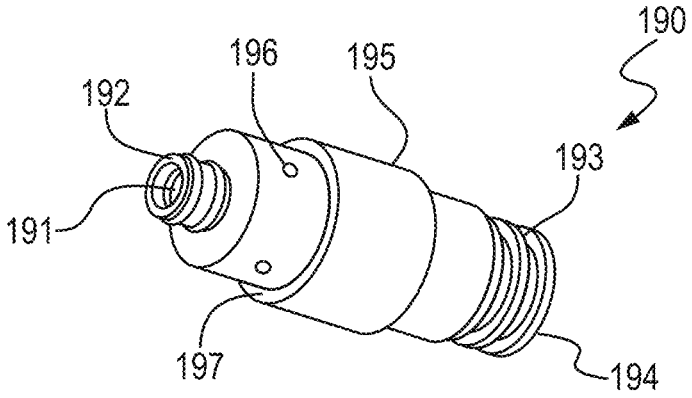
FIG. 12A is a perspective view of the electrical connection sub, which is used in connection with the wireline cutting tools of both FIGS. 1A and 1B, and FIGS. 9A, 9B, and 9C.

The second end 954 of the plunger 950 is dimensioned to receive an upper end of the electrical connection sub (seen at 190 in FIG. 8 and in FIG. 12A). The second end 954 includes holes 957 configured to receive shear pins 959. The shear pins 959 extend into aligned holes 196 located in a body 195 of the electrical connection sub 190. Thus, the shear pins 959 secure the plunger 950 in place during normal operation of the downhole tool.

The shear pins 959 will shear when tension at the first shear load is applied to the electric wireline 105. This will cause the plunger 950 to become disconnected from the electrical connection sub 190 and move up the lower sub 940. As the elongated portion 953 of the plunger 950 advances towards the knife housing 130, it travels through the grease trap 943. The displaced grease enters a bore 951 of the plunger 950. However, due to the small inner diameter of the bore 951 along the elongated portion 953, displacement takes place very slowly. This significantly impedes the travel time of the plunger 950, protecting the knife housing 130 and knives 180 from violent contact with the plunger 950 when tension at the first shear load is applied to the wireline 150.

It is observed that, as a matter of designer's choice, the rate of advance of the plunger 950 towards the knife housing 130 may be manipulated by (i) changing the viscosity of the grease (or other fluid medium) in the grease trap 943 or (ii) adjusting the inner diameter of the upper portion 953 of the plunger 950. The rate of advance may also be manipulated by the operator at the surface based on (iii) the amount of tension applied to the electrical wireline 150.

Figure 9B:
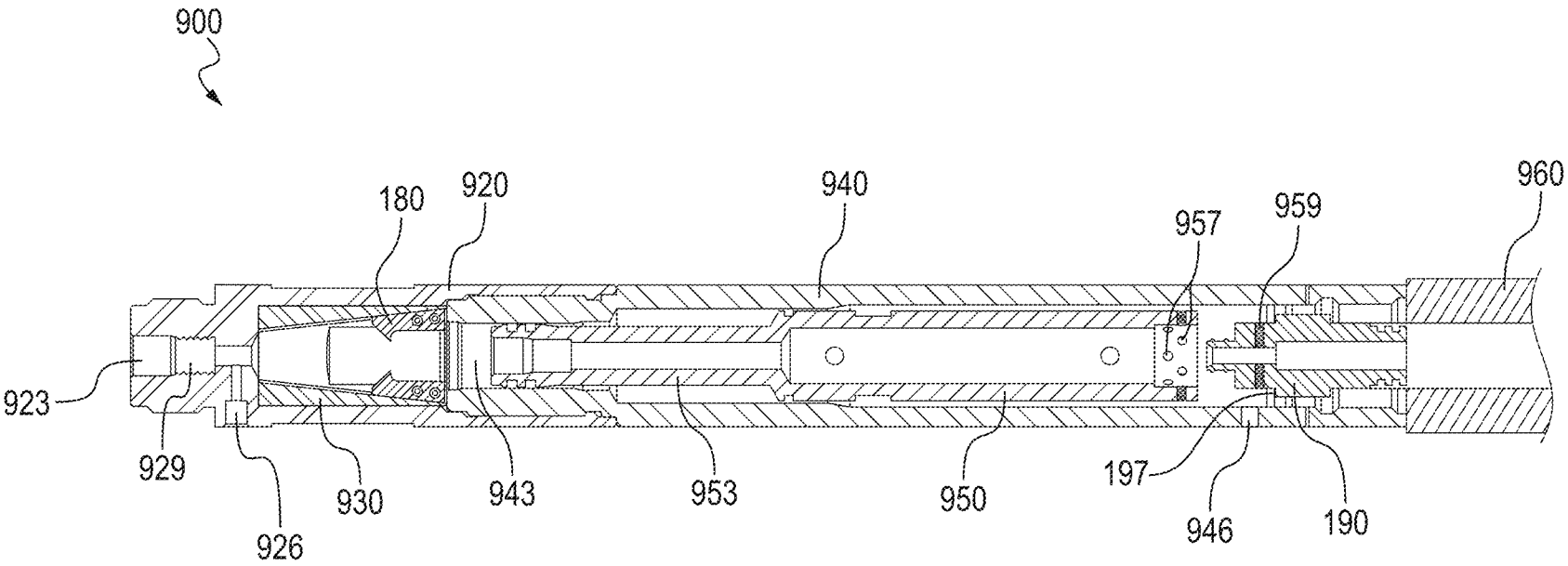
FIG. 9B is another cross-sectional view of the wireline cutting tool of FIG. 9A. Here, a first shear load has been applied to the tool, resulting in a separation of the plunger from the electrical connection sub.

FIG. 9B is another cross-sectional view of the wireline cutting tool 900 of FIG. 9A. Here the first shear load has been applied to the tool 900. This results in a separation of the plunger 950 from the electrical connection sub 190. Shear pins (shown at 959 in FIG. 11C) have sheared, releasing the plunger 950. The wireline 105 is now pulling the plunger 950 up through the bore 941 of the lower sub 940.

FIG. 12A is a perspective view of the electrical connection sub 190, which is used in connection with both of the wireline cutting tools 100 and 900 of FIGS. 1A and 1B and FIGS. 9A, 9B and 9C, respectively. The electrical connection sub 190 resembles a spark plug. It is observed that the electrical connection sub 190 includes a body 195 having a first end 192 and a second end 194, which is opposite the first end 192.

As shown in FIG. 9A, the first end 192 is dimensioned to slide into the second (or lower) end 944 of the lower sub 940. Seals are optionally provided around an outer diameter of the first end 192. A shoulder 197 is formed around the body 195. The lower end 944 of the plunger 950 will "shoulder out" against this shoulder 197.

Figure 12B:
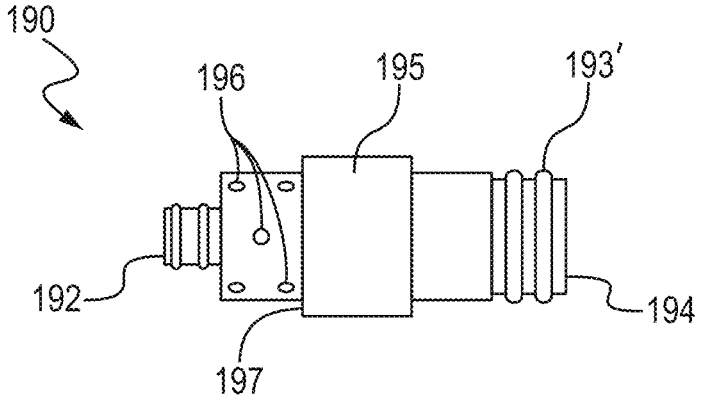
FIG. 12B is a side view of the electrical connection sub of FIG. 12A.

FIG. 12B is a side view of the electrical connection sub 190 of FIG. 12A.

Here, O-rings 193' are added around recesses 193 at the downstream end 194. In each of FIGS. 12A and 12B, holes 196 are visible above the shoulder 197. The holes 196 are configured to align with through-openings 957 and may be configured to receive the shear pins 959.

Figure 12C:
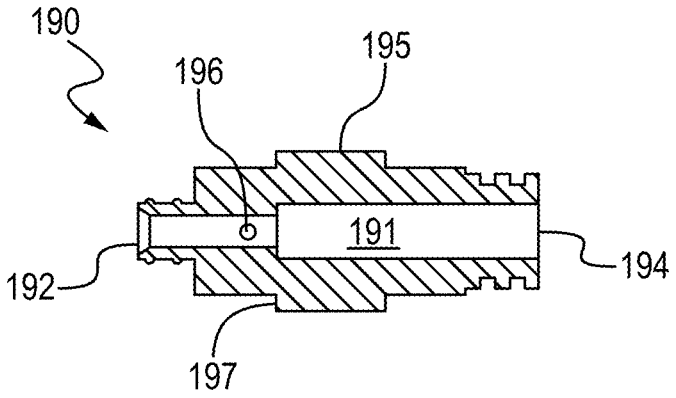
FIG. 12C is a cross-sectional view of the electrical connection sub of FIG. 12A.

FIG. 12C is a cross-sectional view of the electrical connection sub 190 of FIG. 12A. An elongated bore 191 is seen extending through the electrical connection sub 190 from the first end 192 down to the second end 194.

Figure 12D:
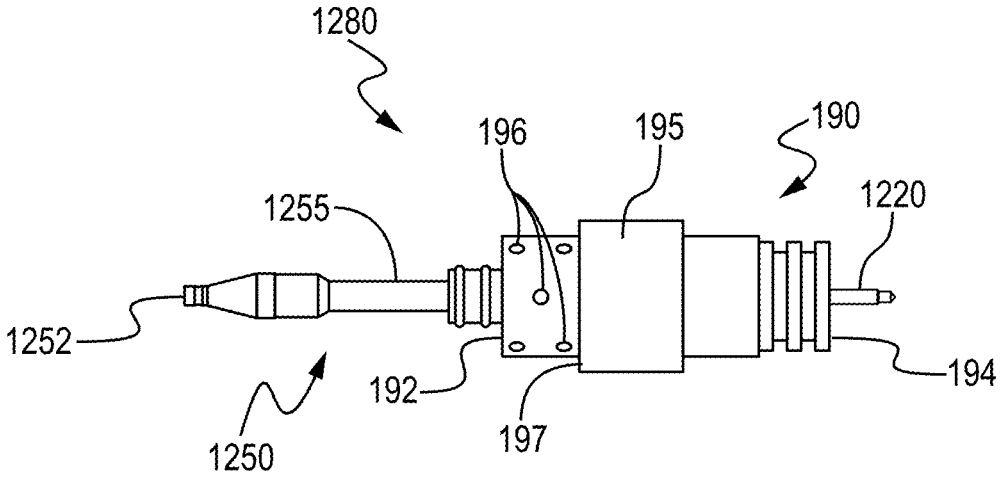
FIG. 12D is another side view of the electrical connection sub of FIG. 12A. Here, the electrical connection sub has received a signal line connector.

FIG. 12D is another side view of the electrical connection sub 190 of FIG. 12A. Here, the electrical connection sub 190 has received an electrically conductive pin 1220 and a signal line connector 1250.

The signal line connector 1250 has a stem 1255. The stem 1255 includes a durable outer layer that protects the electrically conductive pin 1220 as it passes through electrical connection sub 190. The signal line connector 1250 includes a wireline connection end 1252. The wireline connection end 1252 connects to a lowest end of the wireline 105 along the plunger 950. At the same time, the conductive pin 1220 connects to a signal line (not shown) associated with a downhole tool 800. This provides for a quick electrical connection such as by means of a banana clip. Together, the electrical connection sub 190 and the pin 1220 form an electrical connection assembly 1280.

Figure 12E:
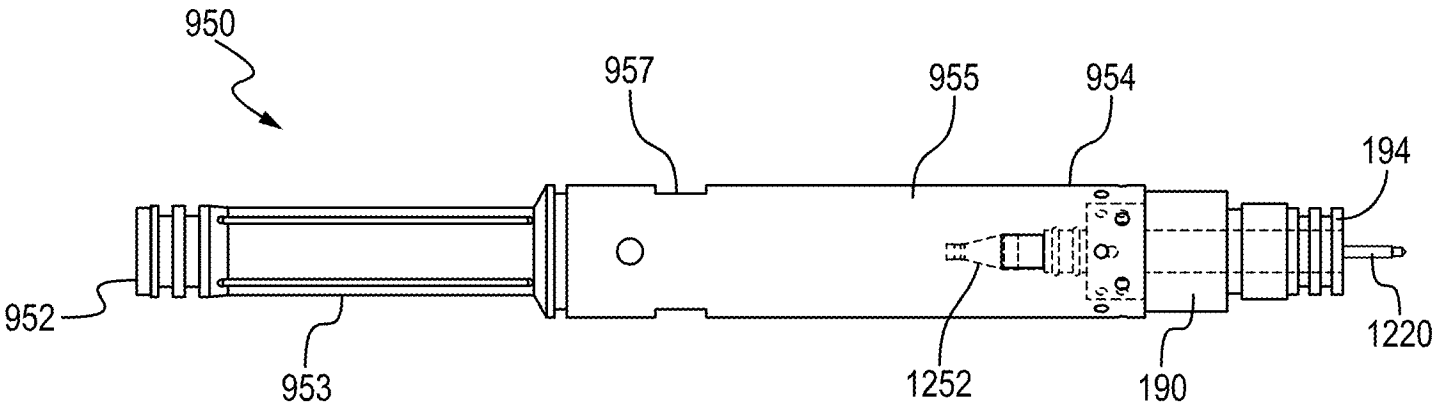
FIG. 12E is still another side view of the electrical connection sub of FIG. 12A. Here, a first, or upstream, end of the electrical connection sub has been positioned inside of a second, or downstream, end of the plunger.

FIG. 12E is still another side view of the electrical connection sub 190 of FIG. 12A. Here, the first, or upstream, end 192 of the electrical connection sub 190 has been positioned inside of the second, or downstream, end 954 of the plunger 950. The second end 954 of the plunger 950 shoulders out on surface 197. It is noted that the wireline connection end 1252 of the signal line connector 1250 is visible, in phantom, within the plunger 950.

Figure 12F:
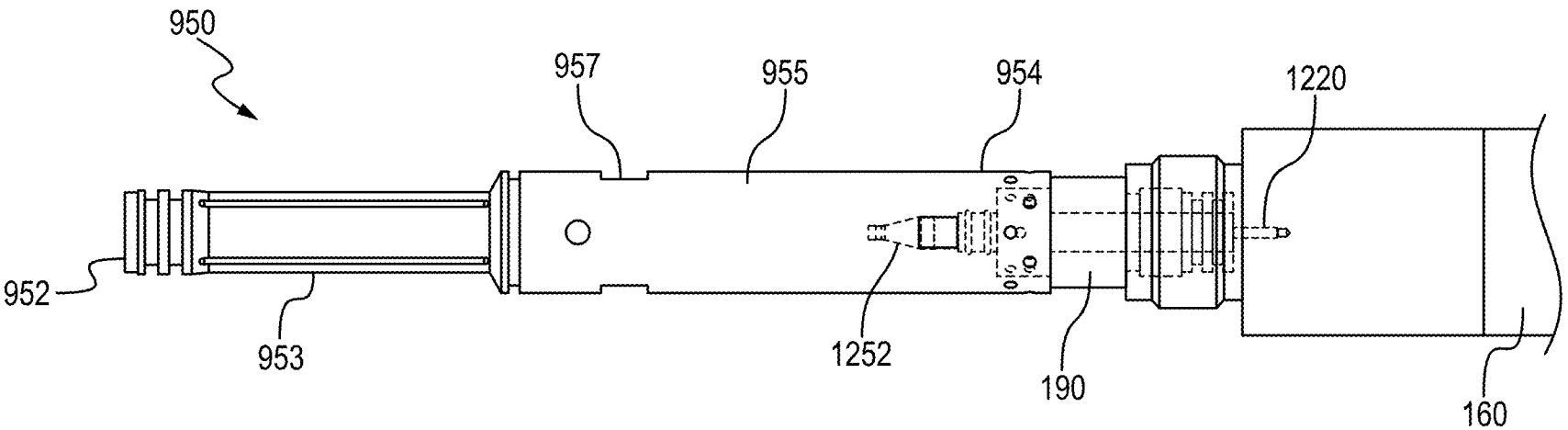
FIG. 12F is yet another side view of the electrical connection sub of FIG. 12A. Here, the first, or upstream, end of the electrical connection sub has again been positioned inside of the second, or downstream, end of the plunger. At the same time, the second, or downstream, end of the electrical connection sub is extending into a downhole tool.

FIG. 12F is yet another side view of the electrical connection sub 190 of FIG. 12A. The upstream end 192 of the electrical connection sub 190 has again been positioned inside of the downstream end 954 of the plunger 950. At the same time, the downstream end 194 of the electrical connection sub 190 is seen extending into the connector sub 160. The electrical connection sub 190 is designed to attach, for example by threaded connection, onto the connector sub 160 or other downhole tool.

The conductive pin 1220 is shown, in phantom, within the connector sub 160. The pin 1220 is then used to transmit signals up and down the wellbore, through the wireline cutting tool 900. Such signals may include:

- detonation signals sent downhole to perforating guns;
- set signals sent to a setting tool for a plug;
- signals sent from a formation logging tool back up to the surface;
- signals sent from a downhole sensor such as a microphone or temperature sensor back up to the surface; and
- signals sent from a casing collar locator or cement bond log.

Figure 13A:
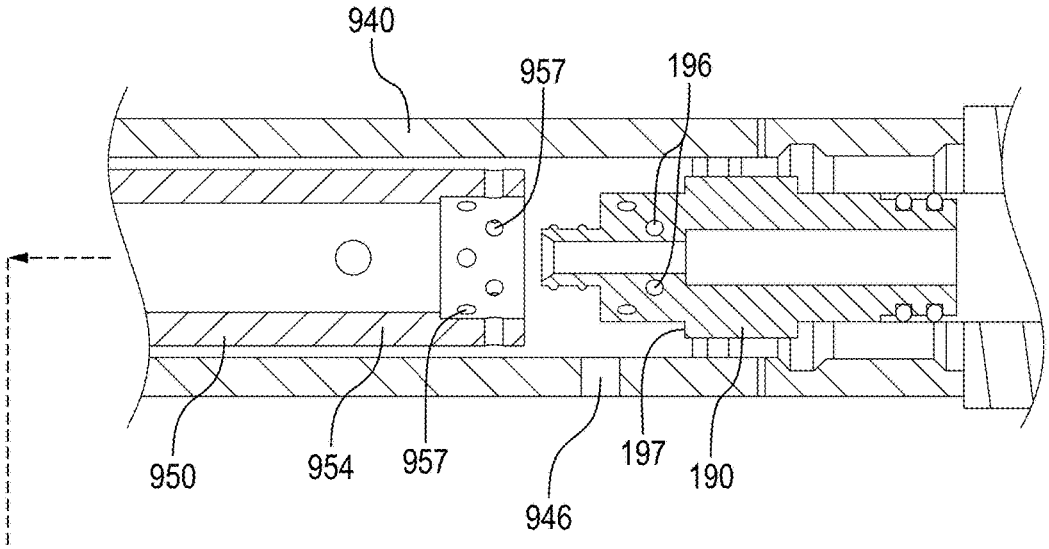
FIGS. 13A and 13B together present an enlarged, cross-sectional view of the wireline cutting tool of FIG. 9B. Here, the plunger has separated from the electrical connection sub and has advanced up the wireline cutting tool. This is in response to a first shear load. The plunger has engaged the knives in the knife housing.
Figure 13B:
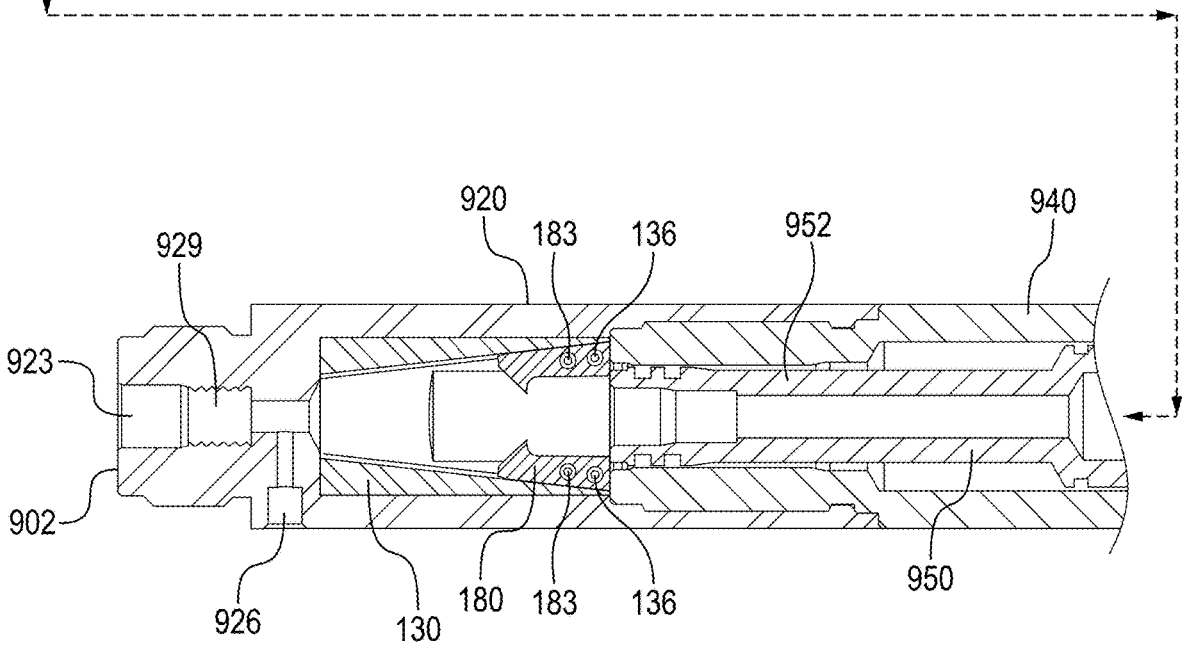

FIGS. 13A and 13B together present an enlarged, cross-sectional view of the wireline cutting tool 900 of FIG. 9B. Here, the plunger 950 has separated from the electrical connection sub 190 and has advanced up the bore 941 of the lower sub 940. An upper end 952 of the plunger 950 has engaged the knives 180 in the knife housing 130. (Note that the pin 1220 and signal line connector 1250 have been removed for illustrative purposes.)

Figure 14A:
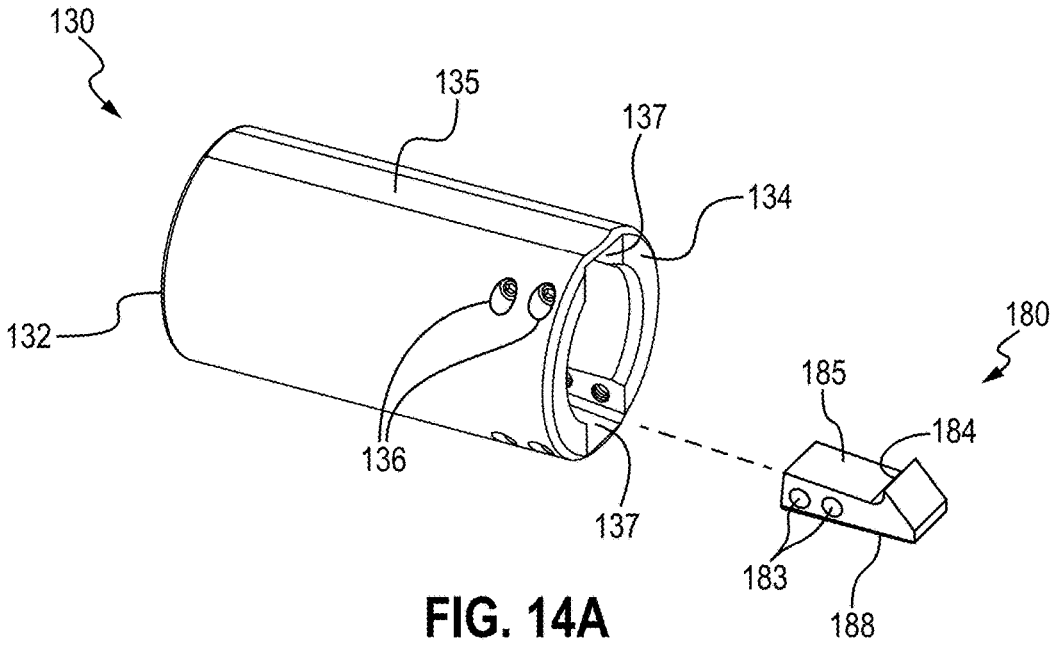
FIG. 14A is another perspective view of the knife housing of FIG. 3A. In this view, the knives have been removed for illustrative purposes. A single knife is shown in exploded-apart relation.

FIG. 14A is another perspective view of the knife housing 130 of FIG. 3A. In this view, the knives 180 have been removed. Channels 137 are revealed, which would otherwise hold the knives 180. A single knife 180 is shown in exploded-apart relation to the knife housing 130. The knife 180 has been removed from channel 137.

It can be seen that the knife 180 includes an inner surface 185. The inner surface 185 faces the bore 131. The knife 180 also has an outer surface 188 which abuts an inner diameter of the knife housing 130. Openings 183 are provided along the knife 180. The openings 183 are dimensioned to align with openings 136 in the body 135 of the knife housing 130 and are configured to slidingly receive the pins 186.

Figure 14B:
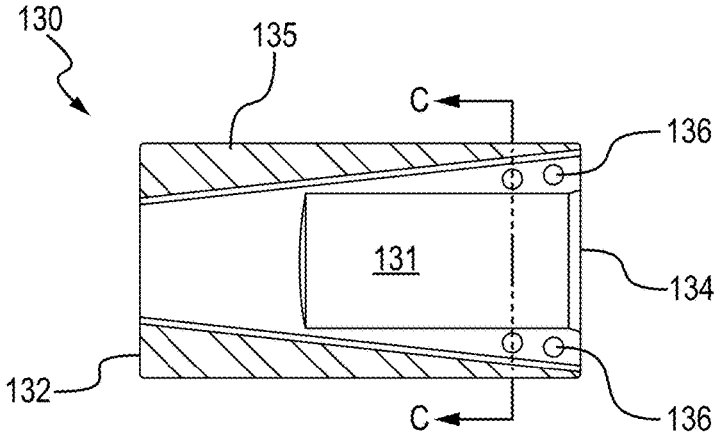
FIG. 14B is a cross-sectional view of the knife housing of FIG. 14A. Again, the knives have been removed.

FIG. 14B is a cross-sectional view of the knife housing 130 of FIG. 14A. This is the same view as is shown in FIG. 3B, except the knives 180 have been removed. The inner bore 131 is visible. Note again that the inner bore 131 tapers inwardly moving from the downstream end 134 to the upstream end 132.

Figure 14C:
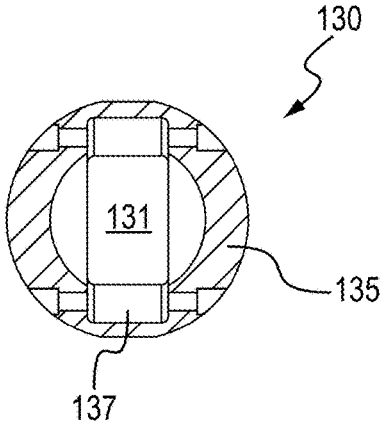
FIG. 14C is another cross-sectional view of the knife housing of FIG. 14A. Here, the cut is taken across Line C-C of FIG. 14B.

FIG. 14C is another cross-sectional view of the knife housing 130 of FIG. 14A. Here, the cut is taken across Line C-C of FIG. 14B. This is the same view as is shown in FIG. 3C, except the knives 180 have again been removed.

Figure 9C:
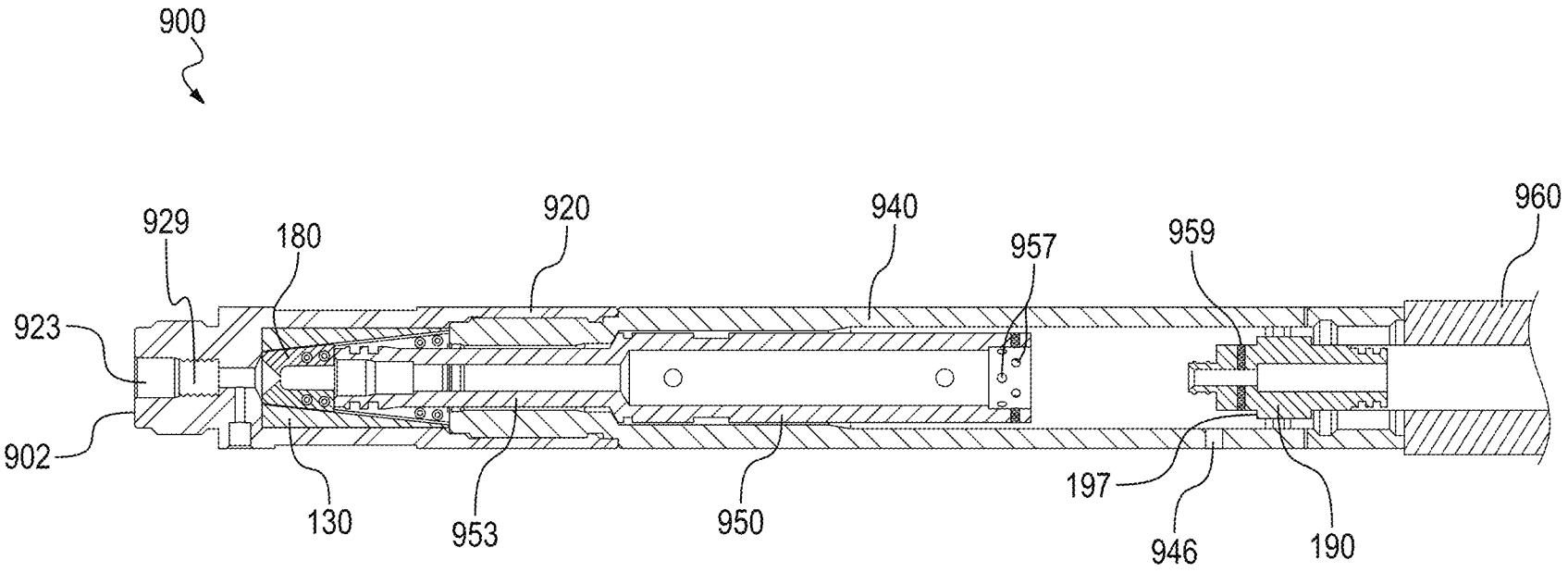
FIG. 9C is yet another cross-sectional view of the wireline cutting tool of FIG. 9A. Here, a second shear load has been applied to the tool, resulting in a sliding of knives up the knife housing. This sliding of knives up the knife housing is in response to a mechanical force applied by the plunger. This severs the wireline.

FIG. 9C is yet another cross-sectional view of the wireline cutting tool 900 of FIG. 9A. Here a second shear load has been applied to the tool 900, resulting in a sliding of the knives 180 up the knife housing 130. This, in turn, causes the cutting edges 184 of the knives 180 to pinch the wireline (not shown in this view), and ultimately to sever the wireline.

Figure 15A:
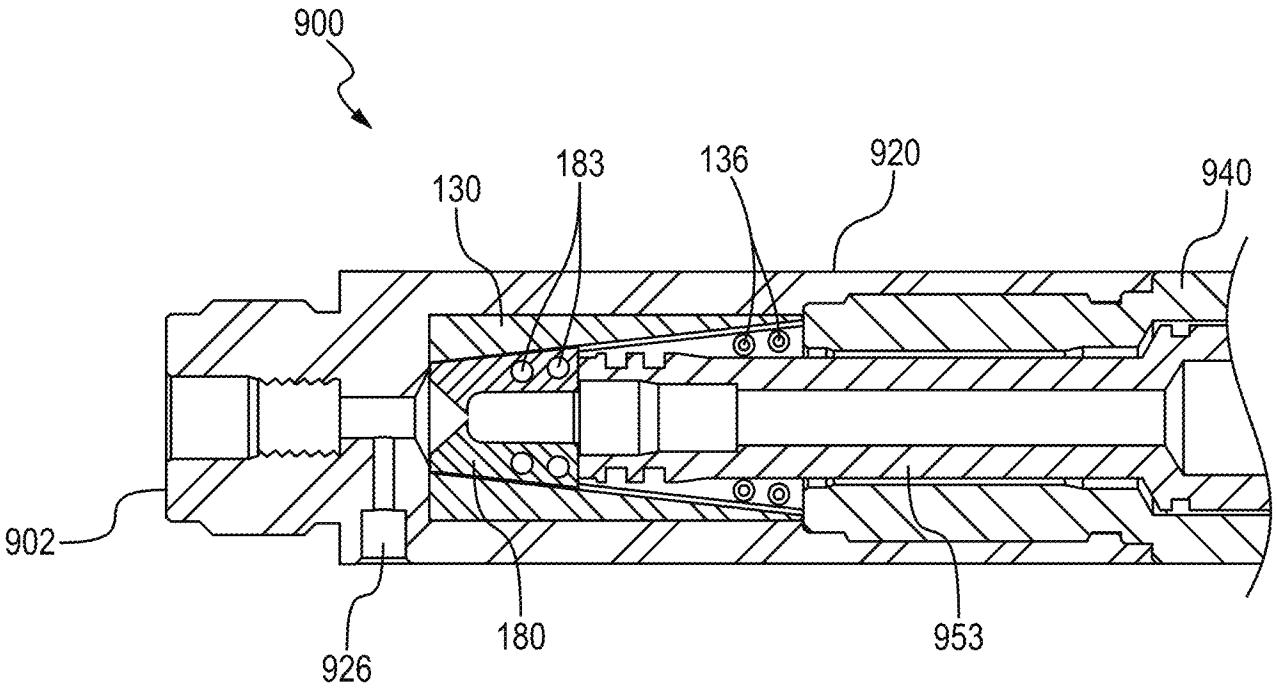
FIG. 15A is an enlarged, cross-sectional view of a portion of the wireline cutting tool of FIG. 9C. Here, the plunger has sheared pins holding the knives in place along the knife housing. This is in response to a second shear load. The knives have moved up the bore of the knife housing.

FIG. 15A is an enlarged perspective view of a portion of the wireline cutting tool of FIG. 9C. Here, the plunger 950 has acted against the knife housing 130, and has sheared pins 186 holding the knives 180 in place along the knife housing 130. This, again, is in response to a second shear load.

Figure 15B:
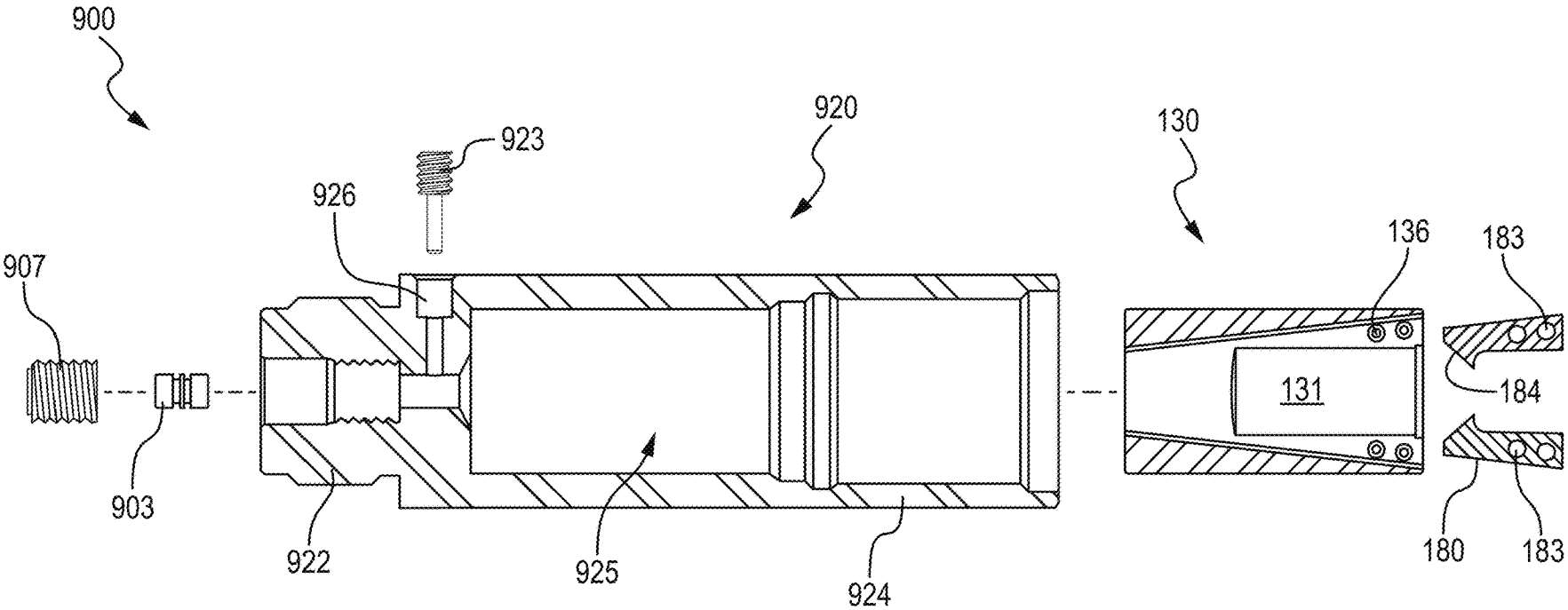
FIG. 15B is a side view of the portion of the wireline cutting tool of FIG. 15A. The knife housing and knives are shown in exploded-apart relation from the upper sub.

FIG. 15B is a side view of the portion of the wireline cutting tool 900 of FIG. 15A. In this view, a bushing 903 and corresponding hex nut 907 are shown exploded apart from the upper sub 920, oriented in an upstream direction. The hex nut 907 is used to screw the bushing 903 down onto the first end 922 of the upper sub 920, holding the bushing 903 in place. At the same time, the knife housing 130 and knives 180 are shown in exploded-apart relation from the upper sub 920 in a downstream direction.

Figure 16A:
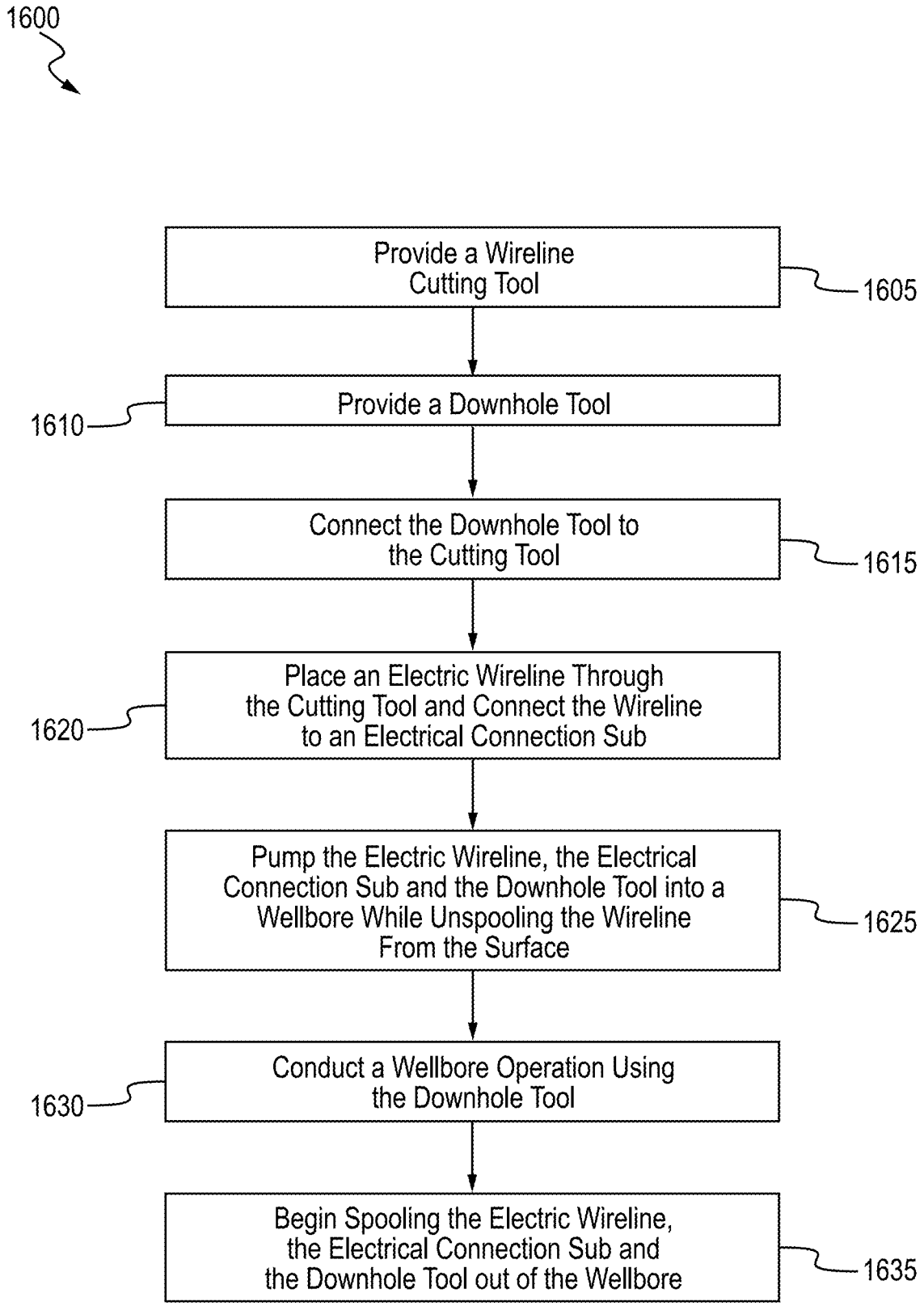
FIGS. 16A and 16B together present a single flow chart showing steps for a method of cutting an electrical wireline within a wellbore, in one embodiment.
Figure 16B:
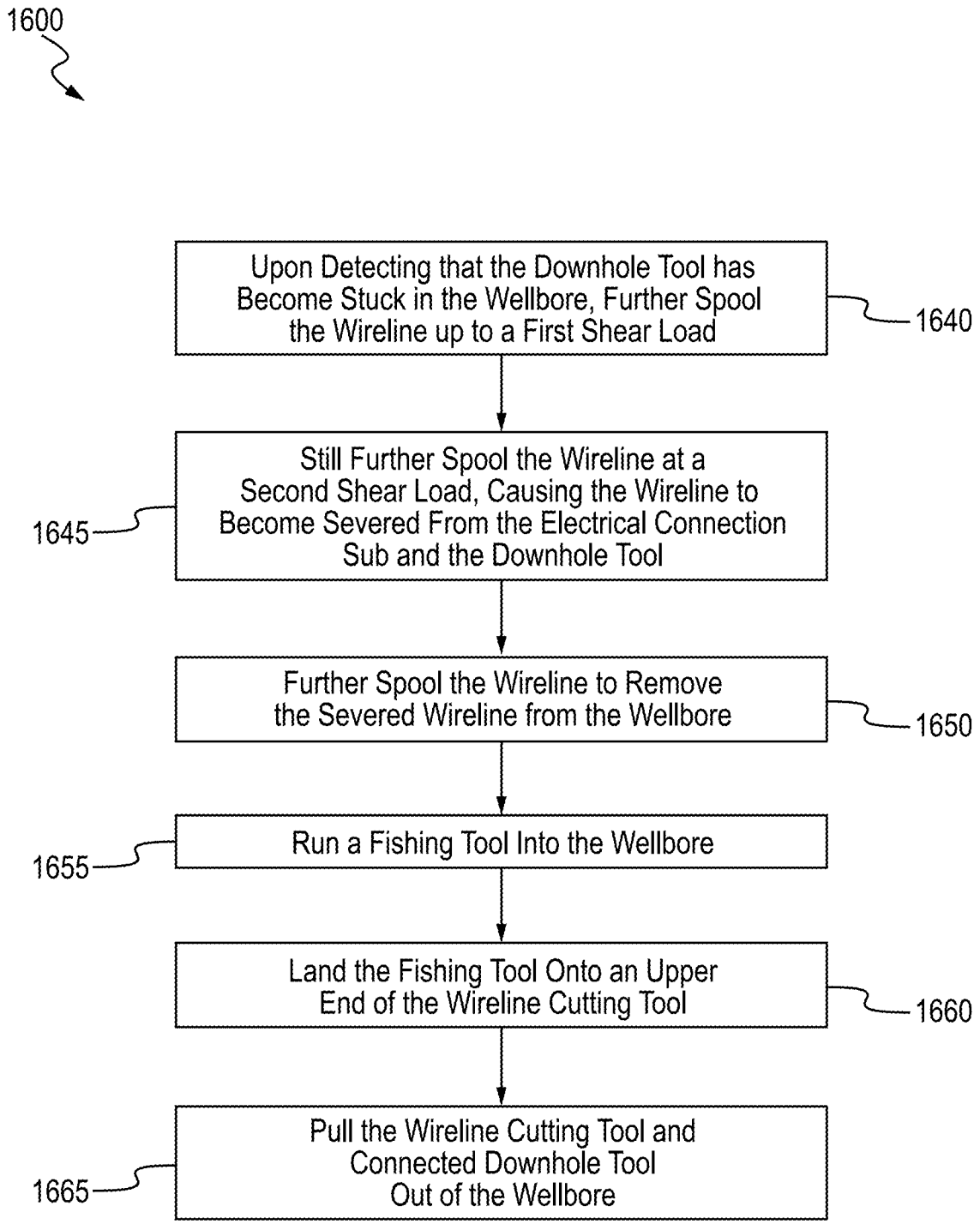

It can be seen that novel wireline cutting tools 100 and 900 have been presented. Using the cutting tools 100 or 900, the present disclosure also provides for a method of cutting an electrical wireline within a wellbore. FIGS. 16A and 16B together present a single flow chart showing steps for a method 1600 of cutting the wireline, in one embodiment.

The method 1600 first includes providing a wireline cutting tool. This is shown in Box 1605. The wireline cutting tool may be configured in accordance with the tool disclosed above in connection with FIGS. 1A and 1B, or FIGS. 9A, 9B and 9C.

In essence, the wireline cutting tool will comprise:

an upper tubular sub, a knife housing residing within the upper tubular sub, at least one knife residing within the knife housing, a lower tubular sub, and a plunger residing within the lower tubular sub.

The method 1600 also includes providing a downhole tool. This is provided in Box 1610. The downhole tool may be, for example, a casing collar locator (optionally including a CCL connector sub) or a perforating gun assembly.

The method 1600 further comprises connecting the downhole tool to the cutting tool. This is shown in Box 1615. Connecting the downhole tool to the cutting tool preferably is done by connecting the downhole tool to a lower end of an electrical connection sub, such as by means of a threaded connection. Alternatively, the downhole tool may be threadedly connected to a downstream end of the lower sub. At the same time, the plunger is releasably connected to an upper end of the electrical connection sub.

The method 1600 next includes running an electric wireline through a bore of each of the knife housing and the plunger. This is seen in box 1620. Preferably, the step of Box 1620 involves stripping away, or splicing, the outer insulating coating of the wireline, exposing the wires, at least through the bore of the plunger. All of the armors of the wireline cable are tied into the plunger, providing the full strength of the wireline to the plunger. This enables the shear pins 959 residing in through-openings 957 and extending into the holes 196 of the electrical connection sub to serve as the point of weakness. Thus, when the wireline is pulled at the first shear load, the plunger is separated from the electrical connection sub.

The method 1600 also comprises pumping the electric wireline, the electrical connection sub, and the downhole tool into the wellbore. This is indicated at Box 1625. Typically, the wellbore will be completed to have a lengthy horizontal section. This is down by forming a dogleg using directional drilling technology as is known in the art. While the tools are moving downhole and across the dogleg, the wireline is unspooled from the surface.

The method 1600 further includes conducting a wellbore operation using the downhole tool. This is seen in Box 1630. The wellbore operation may be, for example, a perforating operation, a plug setting operation, a well logging operation, a formation fracturing operation, or combinations thereof.

The method 1600 also comprises spooling the electric line back up towards the surface. This is provided at Box 1635. As the electric line is spooled, it brings up the wireline cutting tool, the electrical connection sub, and the downhole tool together. As the electric line is spooled, it is not uncommon, or at least it is not rare, for a portion of the tool string to become stuck.

As shown in Box 1640, upon detecting that the downhole tool has become irretrievably stuck in the wellbore, the operator will further spool the wireline. The wireline operator will spool the line until a first shear load is reached. This will cause the plunger to separate from the electrical connection sub and travel up the bore of the lower tubular sub. Stated another way, shear pins 959 will together shear. Immediately thereafter, the plunger will pass through the grease pocket of the lower sub, elongating the conductor cable. This allows the winch operator time to shut down before the second set of pins, that is, the pins in the knife housing, become sheared and the electric wireline is cut.

The time delay afforded by the grease pocket can vary, depending on fluid viscosity, temperature, and the amount of tension applied by the winch operator. The grease prevents the plunger from slamming into the knives, preserving the integrity of the wireline cutting tool for a next job.

It is noted that in a preferred embodiment, a lower end of the wireline is in electrical communication with a pin associated with the electrical connection sub. This may be done, for example, through soldering, by means of a banana clip, or by means of other electrical connector. When the shear pins 959 in the electrical connection sub 190 are sheared in the step of Box 1640, the connection between the wireline 105 and the pin 1220 is also easily broken. This, of course, results in a loss of electrical communication between the surface and the downhole tool(s).

The method 1600 also includes still further spooling the wireline up to a second shear load. This is seen in Box 1645. The second shear load will cause pins 186 holding the knives 180 in place along the knife housing 130 to shear. Because of the angled inner diameter within the knife housing 130, the knives 180 will travel up the bore of the knife housing 130 and squeeze together. The knife blades 184 will pinch the electric wireline 105 to the point of cutting.

The shear pins 959 and the grease pocket/time delay work together with the cutting action to create a more predictable tool. In this way, the wireline 105 may be severed in a clean and efficient manner and the wireline 105 removed, leaving the downhole tool in place within the wellbore. This is provided in Box 1650 and shown in FIG. 15. Per the step of Box 1650, the severed cable is pulled freely out of the wellbore.

Note that in connection with the method 1600, the second shear load is greater than the first shear load.

In one embodiment, the method 1600 further comprises running a fishing tool into the wellbore. This is indicated at Box 1655. The fishing tool is sometimes referred to as an overshot.

The method 1600 may also include landing the fishing tool onto an upper end 902 of the wireline cutting tool 900. This is presented in Box 1660. The method 1600 will then include pulling the wireline cutting tool 900 and connected downhole tool out of the wellbore. This is shown at Box 1665.

Further, variations of the wireline cutting tool and the method of severing an electrical wireline may fall within the spirit of the claims, below. It will be appreciated that the inventions are susceptible to modification, variation and change without departing from the spirit thereof.

What is claimed is:

1. A wireline cutting tool, comprising:

an elongated tubular body having an upper end, a lower end, and a bore extending from the upper end to the lower end;

a knife housing residing within the bore of the tubular body proximate the upper end, the knife housing having a first end, a second end opposite the first end, and a bore extending from the second end and up through the first end, wherein the bore of the knife housing tapers inwardly moving in a direction from the second end of the knife housing to the first end of the knife housing;

a plunger residing within the bore of the tubular body below the knife housing, the plunger also having a first end and a second end opposite the first end, wherein the plunger is held in place by a first shear member at a first longitudinal location and is configured to slide up the bore of the tubular body in response to shearing the first shear member at a first shear load applied by a wellbore wireline; and at least one knife residing along the bore of the knife housing, with the at least one knife being held in place by a second shear member at a second longitudinal location above the first longitudinal location and wherein the at least one knife is configured to slide up the bore of the knife housing from the second end of the knife housing towards the first end of the knife housing in response to shearing the second member at a second shear load applied by the wellbore wireline;

and wherein:

the sliding up of the plunger causes the first end of the plunger to engage a lower end of the at least one knife; and the sliding up of the at least one knife causes the wellbore wireline to be pinched and severed.

2. The wireline cutting tool of claim 1, wherein:

the elongated tubular body comprises:

an upper sub having a first end, a second end opposite the first end, and a bore extending from the second end and up through the first end; and a lower sub having a first end, a second end opposite the first end, and a bore extending from the second end and up through the first end, wherein the first end of the lower sub is connected to the second end of the upper sub;

and wherein:

the knife housing resides within the bore of the upper sub, and the plunger resides at least partially within the bore of the lower sub.

3. The wireline cutting tool of claim 2, wherein:

the first end of the upper sub comprises male threads, while the second end of the upper sub comprises female threads; and the first end of the lower sub comprises male threads.

4. The wireline cutting tool of claim 2, wherein:

the bore of the knife housing and the bore of the plunger are configured to slidably receive the wellbore wireline;

the first shear load is applied to the wellbore wireline by being spooled from a surface, wherein tension is applied to the wellbore wireline that pulls the plunger upward; and the second shear load is applied by the plunger acting against the at least one knife, also in response to the wellbore wireline being spooled from the surface, such that the plunger pushes the at least one knife upward.

5. The wireline cutting tool of claim 4, wherein:

the second shear load is greater than the first shear load.

6. The wireline cutting tool of claim 5, wherein:

an upstream portion of the bore of the lower sub holds grease; and the grease slows the travel of the plunger as it slides up towards the knife housing after the first shear load has been applied to the wellbore wireline.

7. The wireline cutting tool of claim 5, further comprising:

an electrical connection sub defining a tubular body, with the tubular body of the electrical connection sub having a shoulder along an outer diameter that abuts the second end of the plunger, and a bore; and wherein the first shear member comprises at least one shear pin holding the plunger in place along the electrical connection sub.

8. The wireline cutting tool of claim 7, wherein:

the wellbore wireline is an electrical wireline;

the electrical connection sub comprises an electrically conductive pin residing within the bore;

the electrically conductive pin is in electrical communication with the electrical wireline;

a lower end of the lower sub is connected to a downhole tool; and the electrically conductive pin is configured to transmit signals from the electrical wireline through the electrical connection sub and into the downhole tool.

9. The wireline cutting tool of claim 8, wherein the downhole tool is a casing collar locator sub, a well logging tool, or a perforating gun assembly.

10. The wireline cutting tool of claim 8, wherein:

the electrical wireline comprises armors, with the armors being mechanically connected to the plunger; and the at least one shear pin holding the plunger in place with the electrical connection sub comprises at least two shear pins, with the at least two shear pins holding the plunger in place and being designed to shear at the first shear load.

11. The wireline cutting tool of claim 8, wherein the second shear member comprises at least one shear pin holding the at least one knife in place along the bore of the knife housing, wherein the at least one shear pin holding the knife in place is designed to shear at the second shear load.

12. The wireline cutting tool of claim 11, wherein:

the at least one knife comprises a pair of knives disposed on opposing sides of the bore of the knife housing; and the bore of the knife housing tapers inwardly moving from the second end of the knife housing to the first end of the knife housing; and the at least one shear pin holding the at least one knife in place comprises at least one shear pin holding each of the two knives in place.

13. The wireline cutting tool of claim 11, further comprising:

a first grease port residing along an upper portion of the upper sub, configured to receive grease into the bore of the upper sub above the knife housing; and a second grease port residing along an upper portion of the lower sub, configured to receive grease into the bore of the lower sub adjacent the plunger.

14. The wireline cutting tool of claim 11, wherein:

the first end of the upper sub comprises a tubular neck having male threads along an outer diameter of the tubular neck, and female threads along an inner diameter of the tubular neck;

the inner diameter of the tubular neck is aligned with the bore of the upper sub; and the wireline cutting tool further comprises a bushing residing within the inner diameter of the tubular neck, frictionally receiving the wellbore wireline, and a nut threaded into the inner diameter of the tubular neck holding the bushing in place within the tubular neck.

15. A method of cutting a wireline within a wellbore, comprising:

providing a wireline cutting tool, the wireline cutting tool comprising:

an elongated tubular body;

a knife housing residing within the tubular body proximate an upper end;

at least one knife residing within the knife housing;

a plunger residing within the tubular body proximate a lower end; and an electrical connection sub;

releasably connecting the plunger to the electrical connection sub;

connecting the electrical connection sub to a downhole tool below the elongated tubular body;

connecting the downhole tool to the elongated tubular body;

running an electric wireline through a bore of each of the knife housing and the plunger;

mechanically and electrically connecting a lower end of the electric wireline to the electrical connection sub;

pulling the wireline cutting tool, the electrical connection sub, and the downhole tool out of a wellbore together by spooling the electric wireline from a surface;

upon detecting that the downhole tool has become stuck in the wellbore, further spooling the wireline at a first shear load, causing the plunger to separate from the electrical connection sub and travel up a bore of the elongated tubular body, such that the plunger shoulders out against a lower end of the at least one knife; and still further spooling the wireline at a second shear load, causing the at least one knife to travel up the bore of the knife housing and sever the electric wireline within the wellbore, leaving the downhole tool in place within the wellbore;

and wherein the second shear load is greater than the first shear load.

16. The method of claim 15, further comprising:

still further spooling the wireline in order to remove the wireline from the wellbore.

17. The method of claim 15, wherein:

the elongated tubular body comprises:

an upper sub having a first end, a second end opposite the first end, and a bore extending from the second end and through the first end; and a lower sub having a first end, a second end opposite the first end, and a bore extending from the second end and through the first end, wherein the first end of the lower sub is connected to the second end of the upper sub;

and wherein:

the knife housing resides within the bore of the upper sub, and has a first end, a second end opposite the first end, and wherein the bore extends from the second end and through the first end, and with the bore of the knife housing tapering inwardly in a direction from the second end of the upper sub up to the first end; and the plunger resides at least partially within the bore of the lower sub, and also has a first end, and a second end opposite the first end.

18. The method of claim 17, wherein the wireline cutting tool further comprises:

at least one shear pin holding the plunger in place along the electrical connection sub up to the first shear load; and at least one shear pin holding the at least one knife in place along the bore of the knife housing up to the second shear load.

19. The method of claim 18, wherein the downhole tool is a casing collar locator sub, a well logging tool, or a perforating gun assembly.

20. The method of claim 18, wherein:

the at least one shear pin holding the plunger in place comprises at least two shear pins, with the at least two shear pins holding the plunger in place being fabricated to shear at the first shear load;

the at least one knife comprises a pair of knives disposed on opposing sides of the bore of the knife housing; and the at least one shear pin holding the at least one knife in place comprises at least one shear pin holding each of the two knives in place, respectively, with the shear pins holding the two knives in place being fabricated to shear at the second shear load.

21. The method of claim 20, wherein the wireline cutting tool further comprises:

a first grease port residing along a body of the upper sub in fluid communication with the bore of the upper sub above the knife housing;

a second grease port residing along a body of the lower sub; and a grease pocket residing along an upstream portion of the lower sub that receives grease from the second grease port;

and the method further comprises:

injecting grease through the first grease port to facilitate movement of the electric wireline through the upper sub; and injecting grease through the second grease port to provide resistance to the plunger as the plunger slides up the bore of the lower sub towards the two knives after the first shear load has been reached.

22. The method of claim 21, wherein:

the first end of the upper sub comprises a tubular neck having male threads along an outer diameter of the tubular neck, and female threads along an inner diameter of the tubular neck;

the inner diameter of the tubular neck is aligned with the bore of the upper sub; and the wireline cutting tool further comprises a bushing residing within the inner diameter of the tubular neck, frictionally receiving the wireline, and a nut threaded into the inner diameter of the tubular neck holding the bushing in place within the tubular neck.

23. The method of claim 21, wherein:

the electrical wireline comprises one or more armors wrapped around a central conductive wire; and the one or more armors are tied into the plunger.

24. The method of claim 17, further comprising:

running a fishing tool into the wellbore;

landing the fishing tool onto an upper end of the upper sub; and pulling the wireline cutting tool and connected downhole tool out of the wellbore.

* * * * *